US007008184B2

(12) United States Patent
Bettencourt, Jr. et al.

(10) Patent No.: US 7,008,184 B2
(45) Date of Patent: Mar. 7, 2006

(54) CONTROL FOR COOLING FAN

(76) Inventors: Harold Ray Bettencourt, Jr., 96159 Gravelford Rd., Myrtle Point, OR (US) 97458; Nick Bettencourt, 96161 Gravelford Rd., Myrtle Point, OR (US) 97458; Harold Ray Bettencourt, III, 96161 Gravelford Rd., Myrtle Point, OR (US) 97458

( * ) Notice: Subject to any disclaimer, the term of this patent is extended or adjusted under 35 U.S.C. 154(b) by 91 days.

(21) Appl. No.: 10/763,515

(22) Filed: Jan. 23, 2004

(65) Prior Publication Data

US 2004/0151583 A1 Aug. 5, 2004

Related U.S. Application Data

(63) Continuation-in-part of application No. 10/218,417, filed on Aug. 14, 2002, now Pat. No. 6,729,844.

(51) Int. Cl.
*F04D 27/00* (2006.01)

(52) U.S. Cl. ..... 416/1; 416/39; 416/42; 416/61; 415/17; 415/47; 415/51

(58) Field of Classification Search ..... 415/26, 415/17, 51, 47, 18; 416/39, 42, 61
See application file for complete search history.

(56) References Cited

U.S. PATENT DOCUMENTS

| | | | | |
|---|---|---|---|---|
| 4,135,854 | A | 1/1979 | Binstock et al. | 416/37 |
| 6,071,076 | A | 6/2000 | Ansari et al. | 416/168 R |
| 6,109,871 | A | 8/2000 | Nelson et al. | 416/36 |
| 6,113,351 | A | 9/2000 | McCallum et al. | 416/48 |
| 6,126,079 | A | 10/2000 | Shoemaker | 236/35 |
| 6,253,716 | B1 | 7/2001 | Palmer et al. | 123/41.12 |
| 6,532,151 | B1 * | 3/2003 | Osecky et al. | 361/687 |
| 6,592,328 | B1 | 7/2003 | Cahill | 416/155 |
| 6,750,623 | B1 * | 6/2004 | McCauley et al. | 318/260 |

OTHER PUBLICATIONS

Flexxaire® Engine Temperature Control System—F/X Fan Series (Hydraulic Pitch Control), Publication No. 01521, Revision 2, pp. 2-9 and 2-10, Flexxaire® Manufacturing Inc.

3-Position Pneumatic Control Valve Kit Installation Instruction, pp. 1-1 through 1-5, Flexxaire® Manufacturing Inc.

* cited by examiner

*Primary Examiner*—Ninh H. Nguyen
(74) *Attorney, Agent, or Firm*—Greer, Burns & Crain, Ltd

(57) ABSTRACT

A control for changing direction of air flow through a cooling core in response to an external signal and a purge signal includes a logic circuit and a relay assembly. The logic circuit generates a fan control signal based on the external signal, which causes the fan to turn on and operate in a cooling mode and generate an air flow through the cooling core in a first direction, or operate in a neutral mode with reduced or no air flow through the cooling core. The logic circuit also includes at least one timer that internally generates the purge signal, which is then transmitted by the logic circuit to the relay assembly. The purge signal overrides the fan control signal and causes the fan to operate in a purge mode, which causes air flow through the cooling core in a second direction opposite to the first direction.

16 Claims, 13 Drawing Sheets

FIG. 3
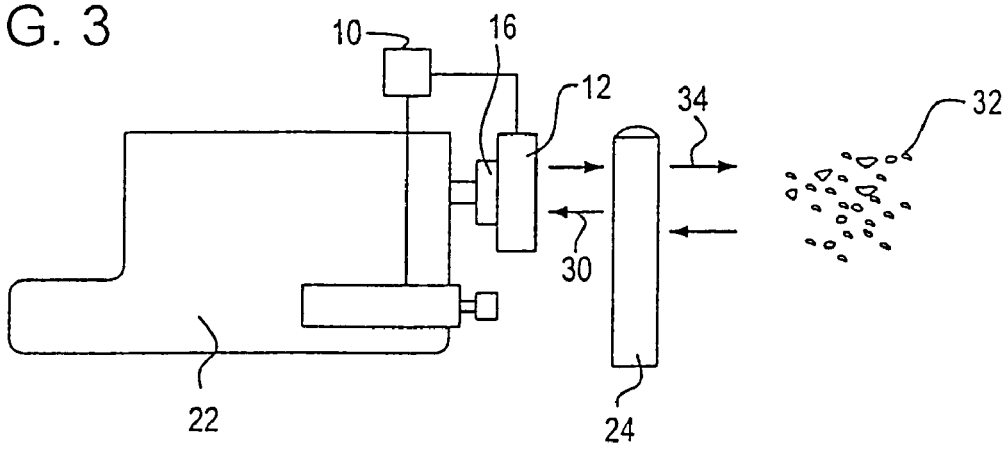
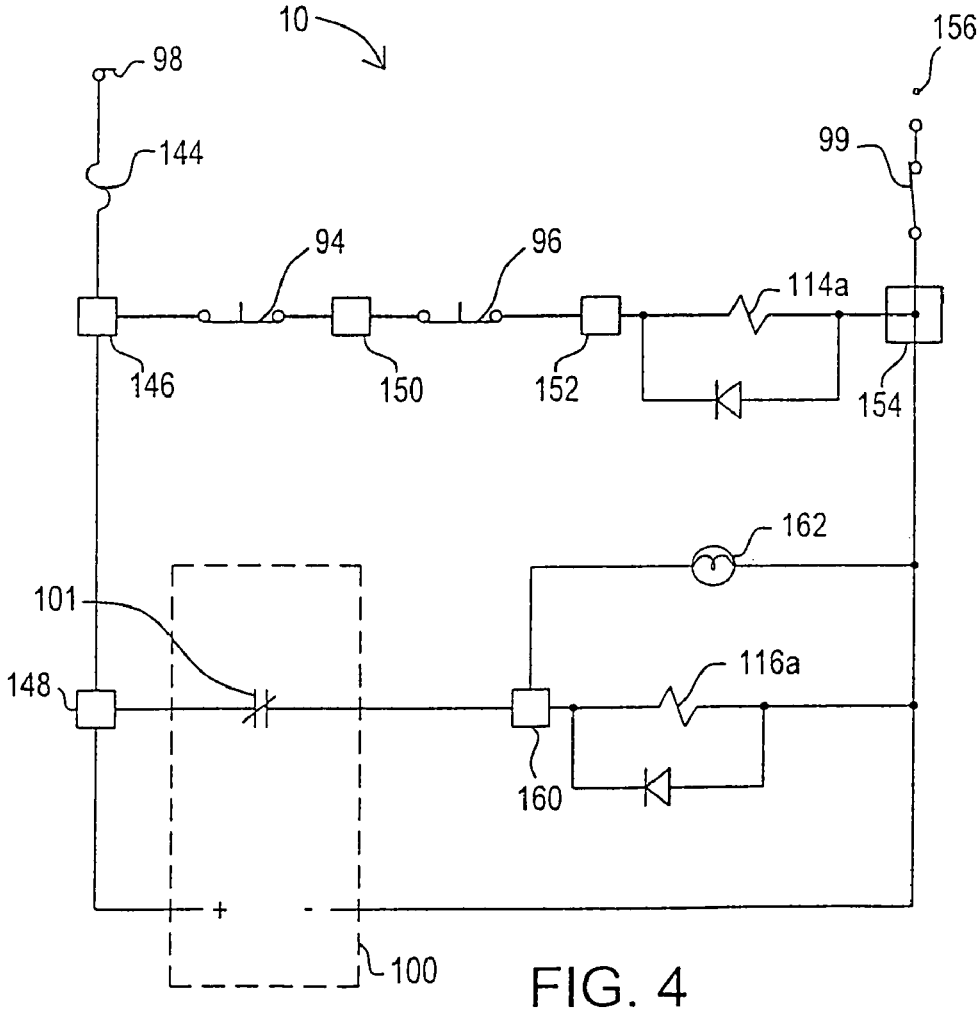
FIG. 4

CONTROL FOR COOLING FAN

CROSS-REFERENCE OF THE RELATED APPLICATION

This is a Continuation-In-Part of Ser. No. 10/218,417, filed Aug. 14, 2002 U.S. Pat. No. 6,729,844.

BACKGROUND OF THE INVENTION

The present invention relates to fan controls, and more particularly to a control and a related method for selectively controlling a direction of air flow for a cooling fan of the type capable of operating in a plurality of operating modes, including a neutral mode, a purge mode, and a cooling mode, such as for cooling a cooling core.

Farms, feedlots and other agricultural plots, as well as construction sites, mining sites and other sites, commonly produce large amounts of fine, particulate, airborne debris. These conditions present a problem for operators of agricultural vehicles such as trucks equipped with feed mixer bodies, tractors, bale pick up machines, silage baggers, composting machinery, bale grinding equipment and forage harvesters. As will be appreciated by those skilled in the art, a feed mixer body is a container having at least one agitator for mixing a plurality of livestock feeds to obtain a substantially uniform livestock feed mixture. Because these vehicles and other equipment incorporating cooling cores often operate virtually non-stop, twenty-four hours a day, the cooling cores (e.g., radiators, oil coolers, air conditioning condensers, and heat exchangers) are constantly exposed to vast amounts of particulate debris. Moreover, since cooling fans ordinarily move air through cooling cores in a single constant direction to facilitate cooling of a fluid contained within the cooling cores, the cooling cores often become clogged with debris, especially in areas having high airborne particulate matter concentrations. Consequently, upon extended use, the cooling cores fail to provide proper cooling of the fluid, and hence components associated with the cooling cores may become damaged due to overheating.

One known method for the removal of debris from the cooling cores operating in areas having high airborne particulate matter concentrations includes requiring an operator to periodically interrupt his work and manually clean out any debris deposited in the cooling core. A disadvantage of manual removal of debris is that it is time consuming and detracts from the optimal work output of the operator. However, unless the operator periodically removes the debris in such a manner, the cooling core will become clogged, which increases the likelihood that the components connected to the cooling core will become overheated and inoperable.

Another drawback of manual debris removal is that the operator must maintain a record or rely on memory as to when to periodically remove the debris from the cooling core. If the operator neglects to remove the debris, then the cooling core can quickly become clogged and cause damage to components protected by the cooling core.

Still another drawback of manual debris removal is that the operator is subjected to hazards associated with cleaning the cooling cores. For example, the cooling cores can be heated to high temperatures, and are typically in close proximity to the extreme heat of the components connected to the cooling cores, e.g., an engine.

Yet another drawback of manual debris removal is that the cooling cores are susceptible to damage by the operator as the operator removes the debris. By way of example, damage to the cooling fins of a radiator can occur during manual debris removal.

In the recreational vehicle industry there is a need for operating a fan actuating mechanism to improve cooling efficiency. In order to improve the efficiency of the cooling systems, and in particular cooling cores in recreational vehicles and the like, such vehicles are typically configured so that for each vehicle a fan is only actuated within very close temporal proximity to the time a vehicle's motor has reached a threshold operating temperature or some other threshold parameter. Otherwise, the engine will be shut down. By way of example, a typical clutch fan can be actuated by an engine electronic control module (ECM) that is actuated by one or more signals indicating a vehicle's temperature exceeds a threshold or other parameters that are hard coded into the ECM for activation when a threshold is reached. When actuated, clutch fans consume excessive power, e.g., up to about 50 horsepower. Accordingly, it is desirable to minimize the amount of time that such fans are in operation. Since the timing of the fan activation cannot be changed in the ECM by a vehicle operator without replacement of the ECM with another ECM programmed with a different timing, many manufacturers of recreational vehicles have chosen to incorporate direct drive fan systems to prevent overheating of the engine, cooling core, and other components adjacent to the cooling core. However, this is insufficient and undesirable because it continually consumes excessive power.

Variable pitch fans for cooling components are well known in the art, wherein fan blades of a variable pitch fan are capable of rotational movement to alter the pitch of the fan blade, and accordingly vary the direction of air flow through the fan blade. Examples of such variable pitch fans are disclosed in U.S. Pat. No. 6,113,351, which is incorporated herein by reference and discloses a hydraulically powered variable pitch fan. U.S. Pat. No. 6,253,716 B1, which is incorporated herein by reference, discloses a pneumatically powered variable pitch fan.

In the '716 patent, an actuator member is connected to each of the axially rotatable fan blade stems with a linkage configured so that linear movement of the actuator member causes axial rotation of the stems. The actuator member is biased to a first position by a spring. The first position represents one rotational extreme of the fan stems. A pneumatically-operated diaphragm is configured to engage the actuator member on an opposite side from the spring. Upon sufficient air pressure exerted against the diaphragm, the force exerted by the springs is overcome causing the stems to rotate to a second position. The amount of pitch may vary to achieve partial stem rotation.

Thus, there is also a need for a control for a fan that features the ability to process information received from engine sensing devices, such as ECM outputs, temperature sensors, and air conditioning pressure switches, and to signal a valve assembly or a set of relays to cause the fan to alter the direction of air flow though the cooling core.

BRIEF SUMMARY OF THE INVENTION

The above-identified needs are addressed by the present apparatus and method of selectively controlling a direction of air flow through a fan of the type capable of operating in a plurality of operating modes. In particular, in one embodiment it is envisioned that the present control is configured to operate a fan of the variable fan blade pitch type in a plurality of fan blade pitch positions, such as a neutral blade pitch position, a cooling blade pitch position, and a purge blade pitch position for controlling the direction of air flow to and from a cooling core. The preferred embodiment is configured for receiving a signal from an electronic control module (ECM) or other monitoring detection equipment and energizing relays and solenoid valves to direct pressurized air through a pneumatic valve assembly. The flow of pressurized air though the pneumatic valve assembly varies the pitch of the fan blades between the cooling mode position and the neutral mode position.

The control, which may incorporate a pneumatic control, further includes a logic circuit that has timers preset by a timer control mechanism. The timers are configured for transmitting a periodic purge signal to the fan, which overrides the cooling or neutral mode of operation and causes the fan to operate in a purge mode for a set time period. In this manner, automatic removal of particulate debris from the cooling core occurs and operator interaction to remove debris is eliminated.

A second embodiment of the pneumatic control is designed for use with a variable pitch fan and combines the relays and solenoid valves into a pair of combined relay and solenoid valve components. More specifically, a relay and a low pressure solenoid valve form a first combined unit and a relay and a high pressure solenoid valve form a second combined unit. An advantage of this configuration is that the control can be manufactured more economically and efficiently.

A third embodiment of the present control is designed for directing air flow through a cooling core. In this embodiment, an electric control selectively controls a non-variable fan blade pitch fan having a DC motor that is also capable of operating in a plurality of operating modes, including a neutral position, a cooling position and a purge position. Similar to the pneumatic control, the electric control has a logic circuit that is configured for receiving one or more external input signals from an ECM or other type of monitor switch that monitors a cooling core or adjacent equipment and instructs the logic circuit to turn the fan on or off. The electric control further includes relays configured for reversing the rotational direction of the fan in response to the external input signals and a purge signal generated by timers of the logic circuit like the pneumatic control's logic circuit. However, unlike the pneumatic control, one key feature of the logic circuit of the electric control is that it is configured to provide a rest delay state to protect the DC motor and other fan components. The rest delay state occurs prior to the fan changing rotation from a forward direction to a reverse direction and vice-versa.

BRIEF DESCRIPTION OF THE DRAWINGS

FIG. 3 is a schematic diagram of the fan of FIG. 2 operating in a sample environment;

FIG. 4 is a circuit diagram of the circuitry operating the pneumatic control of FIG. 1;

DETAILED DESCRIPTION OF THE INVENTION

Figure 1:
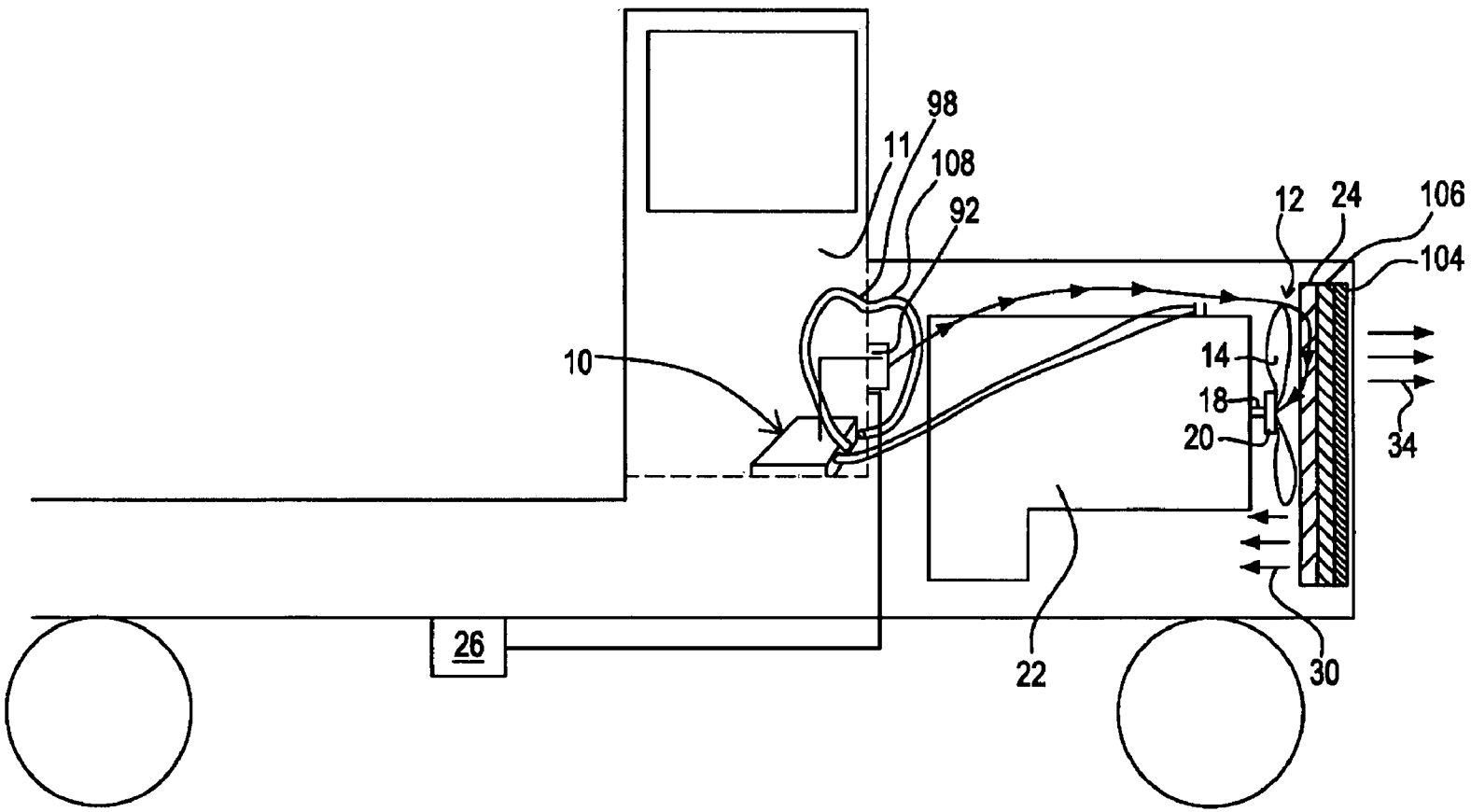
FIG. 1 is a schematic diagram of one embodiment of a pneumatic control illustrated within an environment in which the instant control may be used.

Referring now to FIG. 1, one embodiment of the present control is illustrated as a pneumatic control, indicated generally at 10, and is capable of operating in conjunction with fans configured to cool cooling cores, including conventional variable pitch fans and those fans that are actuated by hydraulic, pneumatic, or electric power. In one embodiment, the control 10 is pneumatic and is mounted in a cab of a vehicle 11, but can be placed in any physical location that allows for electrical connection of the control 10 to the fan. By way of example only, in the present embodiment the instant control 10 will be shown in connection with a variable pitch fan assembly indicated generally at 12. However, the instant invention contemplates that the control 10 can be pneumatic or electrically operated for use with variable or non-variable pitch fans, depending on the control selected.

Figure 2:
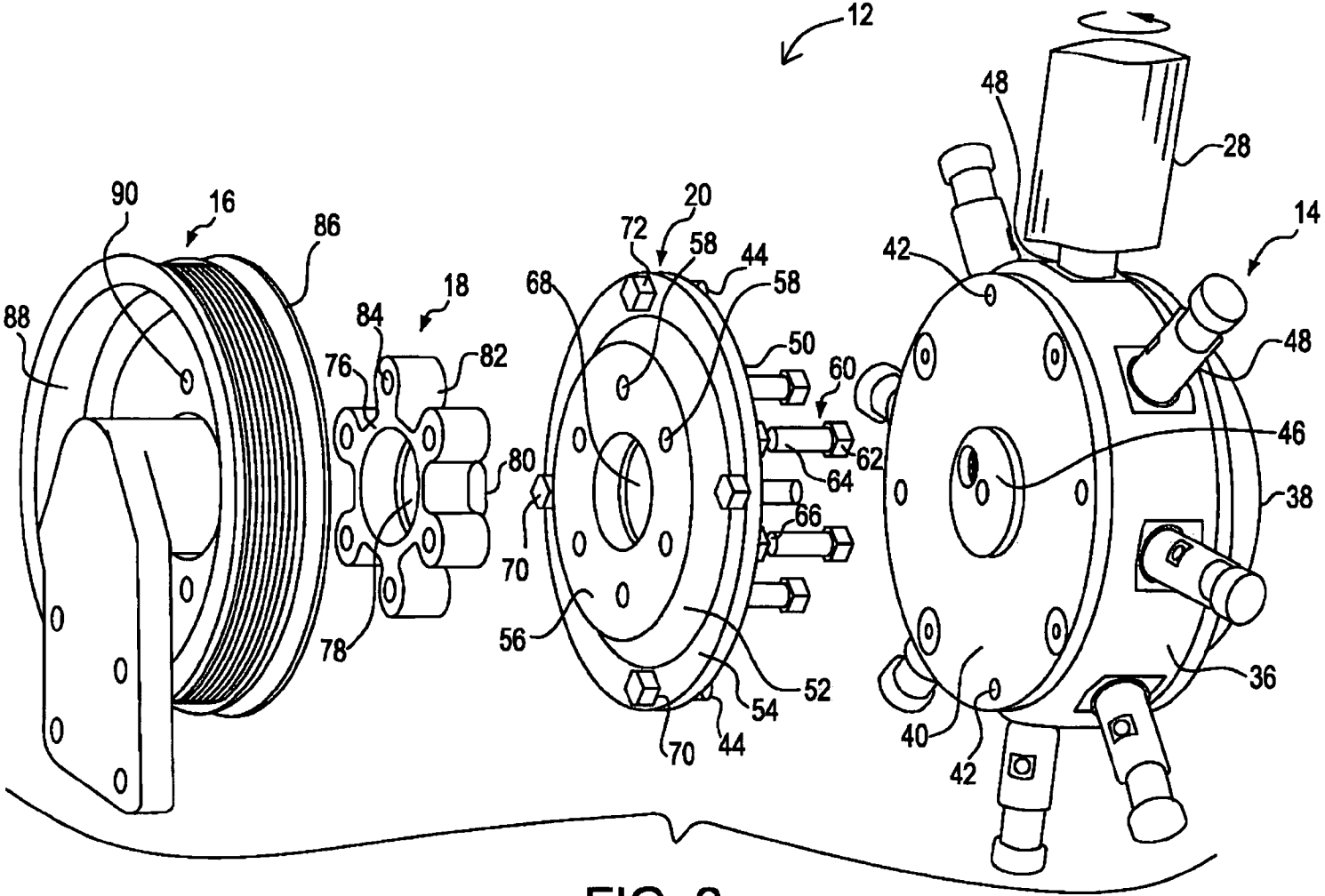
FIG. 2 is an exploded perspective view of a variable pitch blade fan used in conjunction with the instant invention.

As best illustrated in FIGS. 1–3, a preferred embodiment of the variable pitch fan assembly 12 includes a variable pitch fan 14, a fan drive 16, a spacer 18, and an adapter plate 20. The fan 14 itself may further include a fan actuator (not shown). A suitable variable pitch fan 14 is described in U.S. Pat. No. 6,253,716 B1, which is incorporated herein by reference. The variable pitch fan assembly 12 is adapted for use in connection with an internal combustion engine 22 of the vehicle 11, which is ordinarily cooled by a radiator 24 that is in fluid communication therewith. As is known to those skilled in the art, the radiator 24 acts as a cooling core and provides for cooling of the engine 22. Both the fan assembly 12 and a source of compressed air 26 are in fluid communication with the control 10.

The variable pitch fan 14 is driven by the engine 22 of the vehicle 11 via the fan drive 16, and includes a plurality of bladelike fins 28 (best seen in FIG. 2) which are moveable between a plurality of pitch positions for selectively directing the flow of air through the fan assembly 12. For example, in vehicles where the engine 22 is mounted at the front of the vehicle 11, a fan ordinarily operates to cool the engine by drawing air external to the vehicle over and through the radiator 24, thereby cooling the coolant within the radiator, which cools the engine by circulating therethrough. The variable pitch fan 14 operates in a first blade pitch position or cooling mode to facilitate cooling of the engine 22, wherein air is drawn through the radiator 24 and through the fan assembly 12, in the direction represented by arrows 30. Because the first blade pitch position is frequently used to facilitate cooling of the engine 22, it may be referred to as the full cooling blade pitch position. In this first blade pitch position, as air is drawn into the engine, particulate debris 32 suspended in the ambient air, for example, dust, hay chaff, cotton seeds, bark, leaves and wood shavings, is also drawn into the radiator 24 along with the air, where it begins to accumulate. Over time, this debris 32 can clog the radiator 24, thereby causing the engine 22 to overheat.

To combat overheating of the engine 22, the present variable pitch fan 14 is configured for operating in a second blade pitch position or purge mode indicated by arrows 34, wherein the direction of air flow through the radiator 24 is opposite to the direction of air flow when the fan is in its first blade pitch position. In this second blade pitch position, the variable pitch fan 14 draws air away from the engine 22 and toward the radiator 24, which in turn expels the particulate debris 32 away from the radiator. Because particulate debris 32 is purged from the radiator 24, the second blade pitch position is frequently referred to as the full purge blade pitch.

Since vehicle engines do not require any cooling until a certain engine temperature is reached, the variable pitch fan illustrated for use with the instant system also provides a third blade pitch position or neutral mode. In this mode, which is usually a neutral blade pitch position, air is neither pushed away from the engine, nor drawn toward the engine. However, it is contemplated that the third blade pitch position may optionally be defined as any degree of blade pitch or reduced air flow toward or away from the cooling core that is between the full purge blade pitch position and the full cooling blade pitch position, depending on the specifications of the particular manufacturer. By way of example only, the instant embodiment defines the third blade pitch position as the neutral blade pitch position, wherein debris intake is minimized because a fan in neutral blade pitch position moves little to no air in either direction through the cooling cores. The neutral blade pitch position is the normal operating condition of the variable pitch fan 14.

Referring again to FIG. 2, the variable pitch fan 14 includes a housing 36, a generally circular front housing surface 38, a generally circular rear housing surface 40, and a plurality of threaded recesses 42. Preferably, there are four threaded recesses 42 that are configured to receive threaded fasteners 44, however the number of recesses is not critical. An axially extending, preferably cylindrical boss portion 46 is integrally formed with and disposed central to the surface 40 of the variable pitch fan 14. Upon assembly, the cylindrical boss portion 46 centers the fan 14 about the cylindrical boss portion. A plurality of blade spindles or stems 48 radially extend from the housing 36, and are configured to rotate within the housing. Mounted on each blade spindle 48 is a fan blade 28, which is configured to be secured to, and to rotate with the corresponding blade spindle.

The adapter plate 20 includes a front surface 50 and a rear surface 52. In addition, the adapter plate 20 also includes an outer flanged circumference 54 and an inner raised planar circumference 56, which extends axially from a plane defined by the adapter plate 20. Spaced along the inner raised planar circumference 56 of the adapter plate 20 is a plurality of apertures 58. Each of the apertures 58 is configured to receive a partially threaded fastener 60 that has a head portion 62, a shank portion 64, and a partially threaded portion 66. Central to the adapter plate 20 is a large aperture 68, which matingly engages the upwardly extending cylindrical boss portion 46 of the variable pitch fan 14. This engagement acts as a fan pilot and ensures proper alignment and balancing of the fan 14 during rotation.

A plurality of apertures 70 are also spaced along the outer flanged circumference 54 of the adapter plate 20 for receiving individual ones of the threaded fasteners 44. A head portion 72 of each of the fasteners 44 is sized to have a diameter larger than a diameter of each of the respective apertures 70. Thus, the adapter plate 20 is mounted to the variable pitch fan 14 via engagement of the threaded fasteners 44 through the apertures 70 in the outer flanged circumference 54 with the plurality of recesses 42 on the rear surface of the fan 14 that are configured for threadedly receiving the fasteners.

The spacer 18 is included to maintain an appropriate distance between the variable pitch fan 14 and the radiator 24, which maximizes air flow through the fan. The spacer 18 has a front surface, a rear surface 76 opposite to the front surface, and a center aperture 78 for receiving the centering fan pilot of the fan drive 16, which centers the mounted fan 14 to achieve the necessary fan balance when rotating. Integrally formed with the front surface is an axially extending rim wall 80 having a circumference that is defined by a circumference of the center aperture 78. The axially extending rim wall 80 frictionally engages the larger aperture 68 of the adapter plate 20, thereby fixing the adapter plate to the spacer 18. Generally cylindrical lobe members 82 have corresponding throughbores 84 that are circumferentially spaced around the center aperture 78, and are preferably integrally formed with the spacer 18.

The fan drive 16 also has a front surface 86 and a rear surface that connects to the inner surface 88 of the fan drive. The front surface 86 includes a raised generally cylindrical member (not shown) and a plurality of apertures 90 in alignment with the apertures 58 of the adapter plate 20 and the apertures 84 of the spacer 18.

Thus, the assembled variable pitch fan assembly 12 includes the variable pitch fan 14, the adapter plate 20, and the spacer 18 mounted to the fan drive 16. Each component is mounted to the next to ensure that the fan is centered and balanced during rotation. The threaded fasteners 44 engage the apertures 70 along the outer circumference of the adapter plate 20, and the fasteners 44 are prevented from passing entirely through the apertures by the head 72 of the fastener 44 abutting the rear surface 52 of the adapter plate. The fasteners 44 threadedly engage the recesses 42 on the rear surface 40 of the variable pitch fan 14.

Similarly, the fasteners 60 extend through the apertures 58 spaced along the inner raised planar circumference 56 of the adapter plate 20, and are prevented from passing entirely through the apertures 58 by the abutment of the head 62 against the rear surface 52 of the adapter plate. The shafts 64 continue to extend through the apertures 84 of the spacer 18, and the threaded portions 66 threadedly engage apertures (not shown) corresponding to the apertures 58 of the adapter plate 20 and the apertures 84 of the spacer 18. In this way, the variable pitch fan 14 is mounted to the adapter plate 20, which is in turn ultimately mounted to the fan drive 16 through both the adapter plate and the spacer 18.

Turning now to FIG. 4, the first embodiment control 10 of the instant invention controls the blade pitch position of the variable pitch fan assembly 12 in response to one or several predetermined parameters. These parameters may include a predetermined temperature detected at a predetermined location, a predetermined change in pressure within an air conditioning system, a lapsing of a predetermined period of time, or any other engine or monitoring signal provided to an ECM, as is known to those skilled in the art of cooling core systems. Additionally, the instant control 10 allows an operator to manually override the predetermined parameters to effect a predetermined fan blade pitch or mode of operation.

Figure 5:
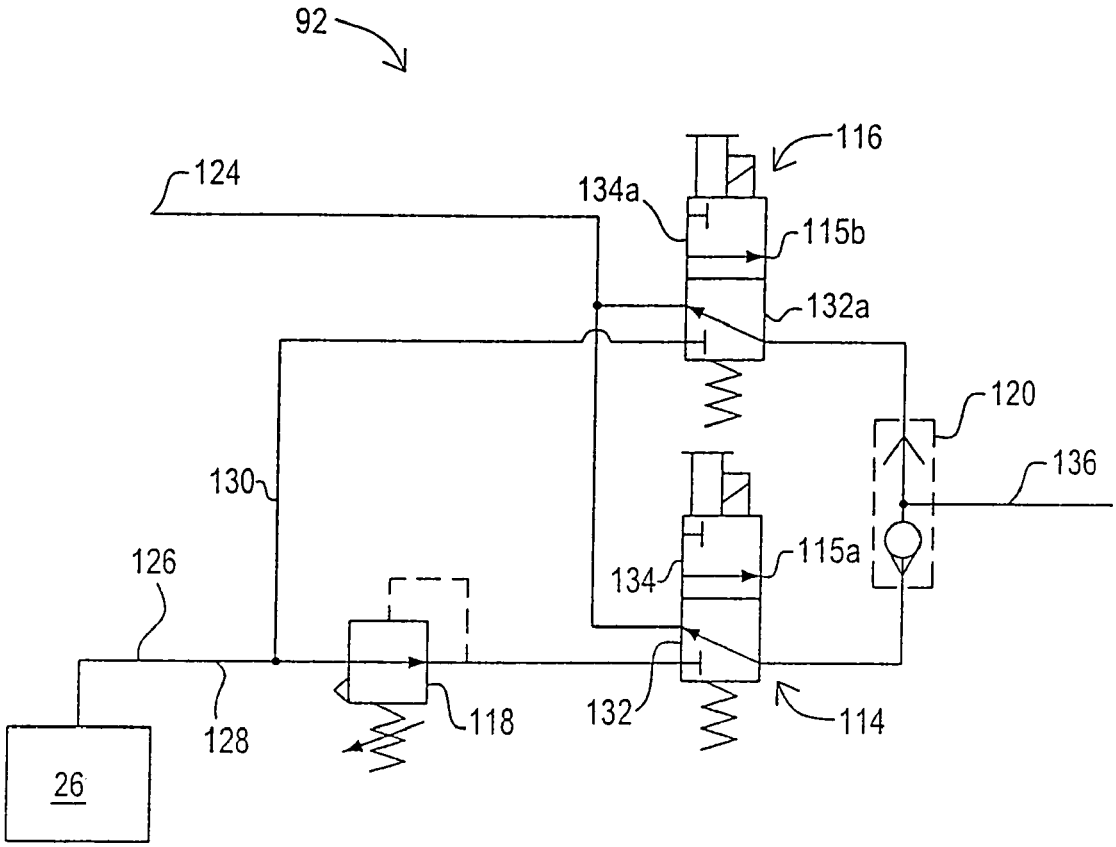
FIG. 5 is a schematic diagram of the valve assembly actuated by the control of FIG. 1.

Referring now to FIGS. 4 and 5, a valve assembly, designated generally at 92 (FIG. 5), controls a flow of fluid. The valve assembly 92 is preferably coupled to the variable pitch fan 14 to energize the variable pitch fan upon selective activation of the valve assembly by the control 10. The valve assembly 92 is also fluidly coupled to the source of compressed air 26.

Several switches may be selectively activated to actuate the variable pitch fan assembly 12. Optionally, as illustrated in FIG. 4, a temperature switch 94 may be activated by a detection of a predetermined temperature at a predetermined location. Alternatively, an air conditioner pressure switch 96 may be activated by detection of the predetermined change in pressure within an air conditioning system. A power switch 98 is also preferably provided with the instant control 10 to initiate electric current flow thereto. The power switch 98 is usually electrically coupled to a vehicle ignition or other manually operated power supply system. A full override switch 99 that is normally closed may also be provided with the present system.

Also, a timer device or time delay relay control 100 may be provided with the instant control 10. The timer device 100 is equipped with internal circuitry to monitor a plurality of parameters, such as a time duration of the fan in a reversed pitch position and a duration of time between signals being transmitted by the control 10 to cause fan pitch position reversal. A relay contact 101 within the timer device 100 may be selectively activated or deactivated to actuate the timer device.

Activation of the switches 94, 96, 98, 99 or the timer device 100 results in selective activation of the valve assembly 92, which ultimately results in changes of blade pitch position of the variable pitch fan 14. It is contemplated that the switches 94, 96, 99 and the timer device 100 may communicate with the valve assembly 92 in numerous manners. In one embodiment the circuitry can include a plurality of relays that may be provided for conveying electrical impulses to the valve assembly 92.

According to one embodiment of the present system, the temperature switch 94, air conditioner pressure switch 96, power switch 98, full override switch 99, and timer device 100 are all electrically connected to a plurality of relays via the relay contact 101 for activating and deactivating the valve assembly 92. The power switch 98 is typically linked to an operator controlled system, such as a vehicle ignition. Thus, when an operator turns on the vehicle 11, the power switch 98 is typically activated.

To this end, each switch 94, 96, 99 typically includes a sensor capable of sensing respective predetermined threshold parameters and signaling the respective switches to respond accordingly if a threshold has been achieved. For example, as illustrated in FIG. 1, the temperature switch 94 is preferably interfaced to a predetermined location, such as the engine 22, and includes a temperature sensor (not shown), which detects temperature and is linked to a temperature measuring device (not shown), which is also typically included in the temperature switch to measure the temperature at the predetermined location. As those skilled in the art will appreciate, the temperature sensing means is typically rated to activate or deactivate according to a predetermined set of parameters or threshold being achieved. The temperature switch 94 may be an integral portion of the control 10, or formed as a separate connectible unit. In one embodiment, the temperature sensor is a thermocouple.

In one embodiment of the instant invention, the temperature switch 94 is coupled to an engine block for measuring the temperature of the engine 22. However, it is contemplated that the temperature switch 94 could be coupled to any number of predetermined locations, such as an oil cooler, the engine radiator 24, a heat exchanger, an air conditioner condenser 104 (FIG. 1) or an air charge cooler 106 (FIG. 1). In FIG. 1, the radiator 24 is illustrated with both the air conditioner condenser 104 and the air charge cooler 106. However, the air conditioner condenser 104 and air charge cooler 106 are optional for use with the instant system. The temperature sensor is preferably electrically connected to the temperature measuring device and senses when a predetermined temperature or threshold temperature has been reached or exceeded by the engine block. For example, the temperature sensor may be configured to activate the temperature switch 94 when the temperature sensor detects a threshold temperature of at least 100° F. from the temperature measuring device. Typically, temperatures ranging above 100° F. may be selected as the predetermined temperature parameter or threshold to be detected. Upon detecting the threshold temperature, the temperature sensor signals the temperature switch 94 to deactivate the temperature switch.

Similarly, the air conditioner pressure switch 96 is commonly known in the art as a high pressure switch and typically includes a pressure sensor (not shown). As those skilled in the art will appreciate, the pressure sensor typically includes a predetermined range for activation or deactivation the air conditioner pressure switch 96. The air conditioner pressure switch 96 may either be an integral portion of the control 10, or formed separately therefrom. In one embodiment, the air conditioner pressure switch is coupled to the vehicle's air conditioner system to monitor pressure within the system. When a predetermined increase in pressure or a minimum threshold pressure is measured by the pressure sensor, the pressure sensor signals the air conditioner pressure switch 96 to deactivate. The manufacturer may select any predetermined pressure threshold to be monitored, for example a pressure threshold of the air conditioning system in the range of 250 psi to 350 psi. In one embodiment, the pressure sensor may be configured to activate the air conditioner pressure switch 96 when the pressure sensor detects a threshold pressure of 250 psi or greater.

The full override switch 99 is preferably a manual control that may be actuated by an operator by pushing a button or toggle, or flipping a switch, for example. The full override switch 99 permits an operator to manually open the circuit at any time, thereby preventing electric current from activating the valve assembly 92.

The switches 94, 96, 99 are preferably configured to be in normally closed positions, so that when electric current is supplied from the power source 98, electric current flows from the power source through the control 10 to energize the valve assembly 92. Opening either of the temperature or air conditioner pressure switches 94, 96 prevents current from flowing to a first solenoid 114*a*, which controls the pitch of the variable pitch fan 14 in conjunction with a second solenoid 116*a*. In one embodiment, the first solenoid 114*a* is a low pressure solenoid, and the second solenoid 116*a* is a high pressure solenoid.

Turning now to FIG. 5, the valve assembly 92 operated by the instant control 10 may be pneumatically or hydraulically powered. By way of example only, one embodiment of the control 10 is illustrated with a pneumatically-powered valve assembly 92 having a first valve 114, which is a low pressure fan solenoid control valve, and a second valve 116, which is a normally closed high pressure fan solenoid control valve. Within each of the first and second valves 114, 116 are the respective pressure solenoids 114*a*, 116*a* (see FIG. 4), which are connected to the control 10. The valve assembly 92 further includes a pressure regulator 118, a shuttle valve 120, and a tee valve, all of which are connected to enable air flow through the valve assembly 92. The source of compressed air 26 is coupled to the valve assembly 92. In one embodiment, the illustrated pressure regulator 118 is a 40 psi regulator. Similarly, the first valve 114 is a 40 psi valve and the second valve 116 is a 120 psi valve. Both the first and second valves 114, 116 are normally closed and in fluid communication with a single exhaust air out passageway 124, through which compressed air supplied by the fan 12 is exhausted when the first and second valves close.

The first and second valves 114, 116 are also in fluid communication with the shuttle valve 120. Activation of the first solenoid 114*a* causes the respective first valve 114 to open. Similarly, activation of the second solenoid 116*a* causes the second valve 116 to open. In their respective open positions, rather than expelling air through the exhaust air out passageway 124, the first valve 114 directs air through a first valve outlet port 115*a* and the high pressure solenoid control valve 116 directs air through a high pressure outlet port 115*b*. The first valve outlet port 115*a* and second valve outlet ports 115*b* are in fluid communication with the shuttle valve 120, which is displaced according to whether the first valve 114 and/or the second valve 116 are open or closed.

The pitch positions of variable pitch fans typically include three benchmark positions: a full cooling blade pitch position where air is directed through the fan in a first direction, a neutral blade pitch position where air is neither pulled nor pushed through the fan, and a full purge blade pitch position, with air being directed through the fan in a second direction, generally opposite to the first direction. Depending on the application, the cooling position may be defined as either a full push blade pitch position or a full pull blade pitch position, and the full purge blade pitch position is then accordingly defined as the blade pitch position generally opposite to either the full pull blade pitch position or the full push blade pitch position.

By way of example only, in the vehicle 11 where the engine 22 is mounted under the hood of the vehicle, a cooling position is typically achieved by pulling air through the radiator and the fan 14 toward the engine. Conversely, in a vehicle where the engine is mounted at the rear of the vehicle, a cooling position is typically achieved by pushing air through the radiator and the fan 14 and then toward the engine. Moreover, in stationary engines, such as the engines used to operate large buildings, whether a cooling position is a push position or a pull position depends on the configuration of the engine as determined by the manufacturer for purposes of cooling. A purge position, as defined herein, is the opposite position of the assigned cooling position. The assigned cooling position may be either the pull or push position. The instant invention contemplates use with fans having either a push or a pull configuration.

As illustrated in FIG. 5, the source of compressed air 26 provides an air supply via an air supply intake 126 at a predetermined pressure, for example 120 psi. Once the compressed air has been emitted from the source of compressed air 26, it can travel through a first passageway 128 to a second passageway 130, or the pressure regulator valve 118, which is set to a predetermined pressure, for example 40 psi. The incoming compressed air usually has an air pressure of about 120 psi, which exceeds the predetermined pressure point of the regulator valve 118, which opens to allow compressed air flow through the regulator valve and to the first valve 114. The first valve 114 and the second valve 116 may be a 2-position, 3-way valve having an open position 132, 132*a* and a closed position 134, 134*a* respectively.

When both the first and second valves 114, 116 are in the closed positions 134, 134*a*, full system air is expelled from the exhaust passageway 124 and no compressed air flows to the shuttle valve 120. Accordingly, the shuttle valve 120 is not displaced in either direction. When the shuttle valve 120 is not displaced, the fan actuator may be configured for altering the fan blade pitch position to a predetermined blade pitch position, such as full cooling blade pitch position.

While the first valve 114 is in the closed position 132, the compressed air is prevented from reaching the shuttle valve 120 from the first valve. When the first valve is in the open position 134, the pressurized air may flow to the shuttle valve 120. If the second valve 116 is closed 134*a*, the higher pressure of the compressed air flowing from the first valve 114 will displace the shuttle valve 120 in the direction of travel of the compressed air from the first valve 114, allowing the compressed air from the first valve to continue to the fan actuator. For example, if the source of compressed air 26 were delivering compressed air at 120 psi, the 40 psi compressed air reaches the fan actuator of the fan assembly 12 after passing through the first valve 114. Displacement of the shuttle valve in the direction of air travel from the first valve 114 being open drives the variable pitch fan 14 at a predetermined pitch position. For example, the fan actuator may be configured so that displacement of the shuttle valve in the direction of air travel with the first valve 114 being open causes the fan 14 to operate in a neutral blade pitch position, where air is neither pulled nor pushed through the fan.

As discussed above, there is a pressure difference between the air flowing from the compressed air source 26 and the air downstream of the regulator valve 118. In the present embodiment, this difference is 80 psi. Therefore, air travels through the second passageway 130 unless the second valve 116 is in an open position 132*a*. The second valve 116 operates in the normally closed position 134*a*, but can be positioned in an open position 132*a*. In the normally closed position 134*a*, compressed air is prevented from reaching the shuttle valve 120. Alternatively, when the second solenoid 116*a* activates the second valve 116 to open, the second passageway 130 allows the compressed air from the compressed air source 26 to flow to the fan actuator when the second valve is in the open position 132*a*.

That is, similar to the first valve 114, the second valve 116 may be a two-position, three-way valve configured to operate in the open position 132*a* and the closed position 134*a*. Opening the second valve 116 will cause the compressed air to flow through the second passageway 130 rather than from the first passageway 128 to the regulator valve 118. If the second valve 116 is open while the first valve 114 is closed, the full 120 psi of compressed air will flow to the shuttle valve 120 and displace the shuttle valve in the direction of air travel determined by the second valve. Even if both the first and second valves 114, 116 are open, the second valve will emit compressed air at a higher pressure than the air from the first valve, resulting in the shuttle valve 120 being displaced due to the flow of air from the second valve. Thus, when the second valve 116 of the instant embodiment is open, the shuttle valve 120 will be displaced based on the direction of air flow from the second valve. The fan actuator may accordingly be configured so that displacement of the shuttle valve 120 causes the fan blades 28 to move to a predetermined blade pitch position, such as the full purge blade pitch position.

Thus, in operation, the control 10 operates to either activate or deactivate one or both of the first and second solenoids 114*a*, 116*b* to cause one or both of the first and second valves 114, 116 to open and close, which consequently affects the pitch or position of the variable pitch fan 14. In the illustrated embodiment, when there is no displacement of the shuttle valve 120, a full cooling blade pitch position is effected, whereas displacement of the shuttle valve in the direction of air travel from the second valve 116 effects a full purge blade pitch position, and displacement of the shuttle valve in the direction of air travel from the first valve 114 effects a neutral blade pitch position.

As best illustrated in FIGS. 4 and 5, when the switches 94, 96, 99 are in the normally closed position, the signal, which is preferably generated by a 12-volt battery power source, which provides electrical current that passes through a 2-amp fuse 144 and the temperature switch 94 and the air conditioner pressure switch 96 (when both switches are closed), the timer device 100, and the full override switch 99. The control 10 is connected to the valve assembly 92 to control opening and closing of the valves 114, 116 of the valve assembly.

More specifically, in one embodiment of the instant invention illustrated in FIG. 4, power is supplied via a vehicle's battery once the vehicle's ignition is activated by turning a key or the like. Electric current provided by the 12-volt battery flows through the fuse 144 and into a first relay 146, which is connected to a second relay 148 in parallel to the temperature switch 94. Therefore, electric current that passes through the fuse 144 may flow through the first relay 146 to the second relay 148 and/or the temperature switch 94 under certain circumstances, as described below.

Because the temperature switch 94 is in its normally closed position, electric current supplied to the temperature switch from the first relay 146 can flow through the temperature switch to a third relay 150 if the pressure switch 96 is closed. The third relay 150 is connected in series to the air conditioner pressure switch 96, which is also normally closed. Hence, electric current normally flows to the third relay 150 and through the air conditioner pressure switch 96 to a fifth relay 152, which is also normally closed. The fifth relay 152 is connected in series to the first solenoid 114*a*, which allows electric current to flow to the first solenoid from the fifth relay. Electric current from the first solenoid 114*a* also flows to a sixth relay 154, which is normally closed, and then through the normally closed full override switch 99 to a common ground 156 (connecting to the ground 156 not shown). A diode 158 is connected in parallel with the first solenoid 114*a* to prevent damage thereto upon the opening and closing of switches 94, 96.

The timer device 100 is preferably equipped with internal circuitry to monitor a plurality of parameters, such as duration of fan pitch reversal and the duration of time between fan pitch reversal. To this end, the relay contact 101 is controlled by the timer device 100, which is programmed to maintain the relay contact in an open position for a predetermined period of time, and then briefly close the relay contact for a predetermined duration, following which the relay contact will resume its open position. It is contemplated that the predetermined period of time in which the relay contact 101 is open and the predetermined duration during which the relay contact is closed could be modified to suit individual applications. The timer device 100 may include a 15A fuse to protect the timer device from the power source. For example, in one embodiment, the timer device 100 is programmed to maintain the relay contact 101 in the open position for 20 minutes, and following the elapsing of 20 minutes, the timer device closes the relay contact for a period of 8 seconds. After 8 seconds, the relay contact 101 resumes its open position. Thus, electric current is prevented from flowing to the second solenoid 116*a* for 20 minutes, following which time electric current flows to the second solenoid to activate the second solenoid for a duration of 8 seconds. Then the second solenoid 116*a* acts as an open circuit when the relay contact 101 opens once again.

Only when the relay contact 101 is closed for the predetermined duration does electric current flow from the timer contact to the fourth relay 160. Electric current received by the fourth relay 160 flows to both a purge cycle indicator 162, which is preferably a filament, and to the second solenoid 116*a*, which is connected in parallel to the indicator 162. Because electric current flows to both the purge cycle indicator 162 and the second solenoid 116*a*, and because electric current flowing through the second solenoid 116*a* effects a full purge blade pitch position, the purge cycle indicator illuminates to indicate that a purge cycle is commencing. Similar to the first solenoid 114*a*, the second solenoid 116*a* has a diode 164 in parallel therewith to prevent damage to the solenoid 116*a* upon opening and closing of the relays 148 and 160, for example. From the second solenoid 116*a*, electric current flows to the common ground 156 when the switch 99 is closed.

In operation of the above-described embodiment of the control 10, actuating the vehicle ignition enables electric current to flow through the normally closed switches 94, 96, 99, and the relays 146, 148, 150, 152, 154, 160 and to the relay contact 101 when the switches and relays are closed.

Typically, when the vehicle ignition is activated, the timer device 100 will begin tolling the predetermined time period, which in one embodiment is 20 minutes. Since the timer device 100 will not signal the relay contact 101 to close until 20 minutes has elapsed, the relay contact is generally in the open position when the vehicle ignition is activated, and will prevent electric current flow to the second solenoid 116*a*. Air from the second valve 116 is therefore diverted to the exhaust air out passageway 124. However, the switches 94, 96, 99 are typically closed when the vehicle ignition is actuated, and therefore only the second solenoid 116*a* will usually be actuated when the vehicle ignition is actuated. Consequently only the second valve 116 will usually open to allow compressed air from the second valve to reach the shuttle valve 120. The shuttle valve 120 will therefore be displaced in the direction of air flowing from the second valve 116, which is the high pressure solenoid control valve.

In this manner, the instant control 10 may be configured so that actuating the vehicle ignition actuates the fan blades 28 to a full purge position.

After 20 minutes elapse, the relay contact 101 is closed, allowing electric current to flow through the relay contact 101 to the second solenoid 116*a*. If the normally closed temperature and air conditioner pressure switches 94, 96 are both in the closed position, electric current flows to the first solenoid 114*a* and the second solenoid 116*a* for as long as the relay contact 101 remains open, which in the instant embodiment is determined to be 8 seconds. For the predetermined duration of 8 seconds, both the first and second solenoids 114*a*, 116*a* are energized, which in turn actuates both the first and second valves 114, 116. In response, both the first and second valves 114, 116 open, and compressed air flows from each valve to the shuttle valve 120. However, since the valve assembly 92 is configured so that the second valve 116 is a higher pressure valve than the first valve 114, the shuttle valve 120 will be displaced in the direction of air flow from the second valve. In this manner, the instant control 10 may be configured so that closing the relay contact 101 while maintaining the temperature and air conditioner switches 94, 96 in the normally closed positions actuates the fan blades 28 to a full purge blade pitch position. The fan blades 28 will remain in the full purge blade pitch position until the predetermined duration of 8 seconds has elapsed, at which time the relay contact 101 will open, causing an open circuit to the second solenoid 116*a*. Since electric current is still flowing to the first solenoid 114*a*, the shuttle valve 120 will then be displaced in the direction of air flowing from the first valve 114 only, which returns the fan blades to a neutral blade pitch position for another predetermined time period e.g., 20 minutes if there is no demand for the fan to operate in the cooling mode (i.e., the switches 94 and 96 are closed). The cycle can be repeated indefinitely.

As previously discussed, one embodiment of the present system includes the temperature switch 94 coupled to an engine block to sense when a predetermined temperature condition has been reached by the engine block, for example 100° F. At that time, the temperature sensor may cause the temperature switch 94 to open. When the temperature switch 94 opens, electric current is prevented from flowing through the temperature switch, including the first solenoid 114*a*, which consequently closes the first valve 114 to exhaust air through the exhaust passageway 124.

Similarly, detection of a predetermined pressure condition by the air conditioner pressure switch 96 may cause the air conditioner pressure switch 96 to open, which prevents electric current from flowing through the air conditioner pressure switch, including to the first solenoid 114*a*. Thus, when either one or both of the temperature switch 94 and the air conditioner pressure switch 96 are open, the first solenoid 114*a* forms an open circuit preventing actuation of the first valve 114.

Thus, assuming that either one or both of the temperature or air conditioner pressure switches 94, 96 are open, and assuming that the predetermined time period of 20 minutes has not elapsed to trigger the closing of the relay contact 101, current is prevented from flowing to either the first or second solenoids 114*a*, 116*a*. Like the first valve 114, the second valve 116 is therefore also closed and air is exhausted out through the exhaust passageway 124. Thus, no air reaches the shuttle valve 120, which is therefore not displaced in either direction. In this manner, the instant control 10 may be configured so that opening of either the temperature or air conditioner pressure switches 94, 96 while the relay contact 101 is open will result in a full cooling fan blade pitch position. However, once 20 minutes has elapsed, and the relay contact 101 closes, assuming that one or both of the switches 94, 96 are still open, electric current will flow to the second solenoid 116*a* to effect a full purge blade pitch position for 8 seconds, at which time it will return to the full cooling fan blade pitch position.

Optionally, the present system may include the manual override switch 99, where a vehicle operator is able to manually open the normally closed override switch. By pressing a button, flipping a switch, or other satisfactory signaling methods, the operator actuates the override switch 99 to the open position. Since the override switch 99 is last in series before the common ground 156, the entire circuit becomes an open circuit if the switch is open. In this situation, neither the first nor the second valves 114, 116 open, and the pressure in the control 10 drops to zero, effecting a full cooling blade pitch position. In this way, the operator has an optimal override for cooling and may, at will, set the fan to a full cooling blade pitch position regardless of the respective positions of the temperature switch 94, the air conditioner pressure switch 96, or the relay contact 101.

Figure 6:
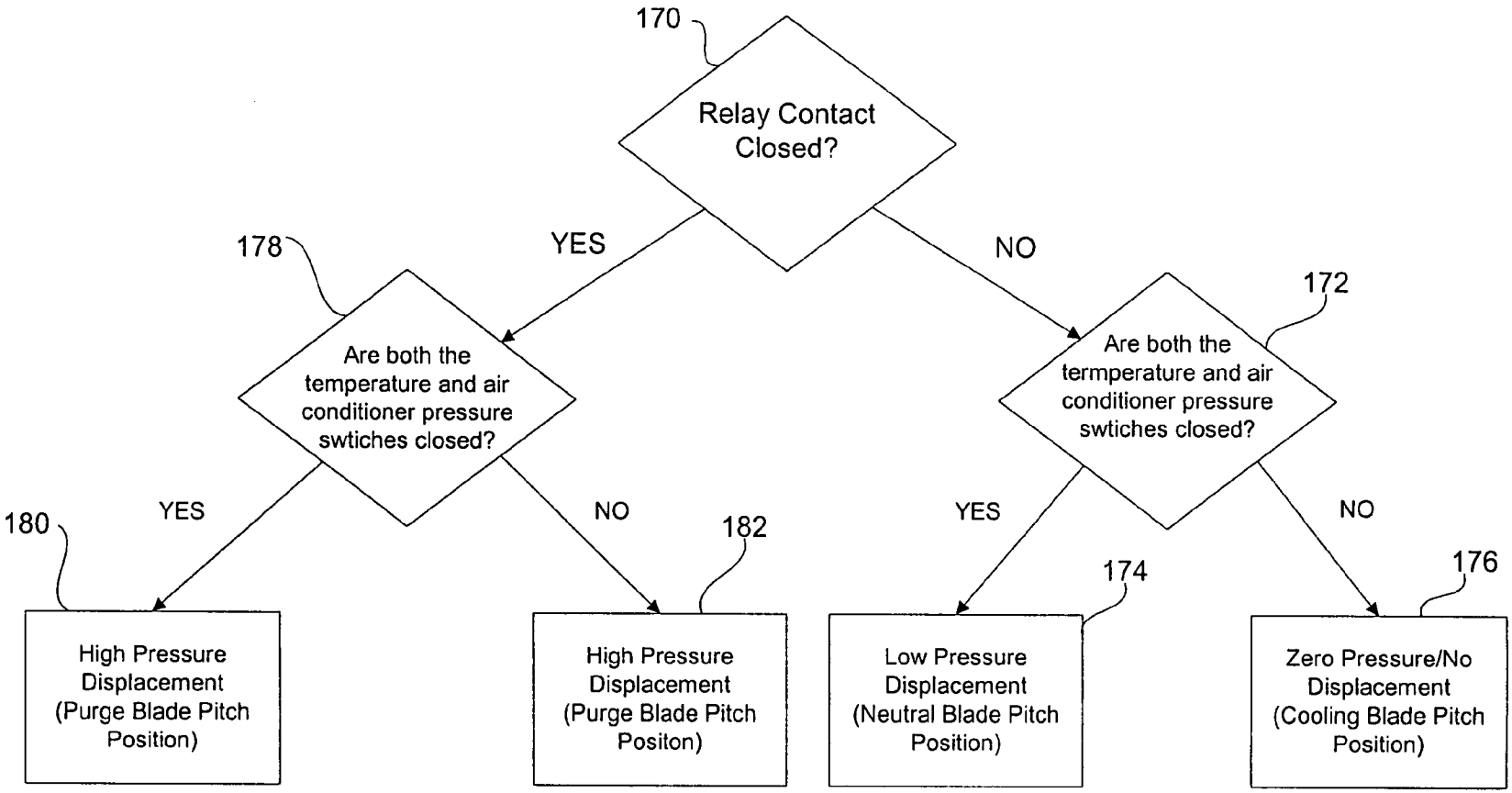
FIG. 6 is a flow chart illustrating the pneumatic control of the present invention.

In summary of the above-described embodiment, a flow chart provided in FIG. 6 illustrates the effect upon the fan assembly 12 by operation of the instant control 10. When system power is supplied to the control 10 by vehicle ignition or other means, a first step 170 is determining whether the timer contact 101 is in the open or closed position. Assuming that the timer contact 101 is open, it may then be determined whether or not both the temperature switch 94 and air conditioner pressure switch 96 are in the normally closed position (step 172). If both switches 94, 96 are closed, low pressure displacement of the shuttle valve 120 results in a neutral blade pitch position (step 174). However, if either one or both of the temperature or air conditioner pressure switches 94, 96 are open, there is no displacement of the shuttle valve, resulting in a full cooling blade pitch position (step 176).

However, if the relay contact is closed at step 170, it may then be determined whether both of the temperature and air conditioner pressure switches 94, 96 are in the open positions (step 178). If one or both switches 94, 96 are open, there is high pressure displacement of the shuttle valve, resulting in a full purge blade pitch position (step 180). Similarly, if both of the temperature and air conditioner pressure switches 94, 96 are closed, there will still be displacement of the shuttle valve 120 in the direction of air travel from the second valve 116, and a full purge blade pitch position will again be achieved for as long as the relay contact 101 remains closed. Thus, closing the relay contact 101 following the predetermined period of time results in a full purge blade pitch position, regardless of the position of the temperature and air conditioner pressure switches 94, 96.

Figure 7:
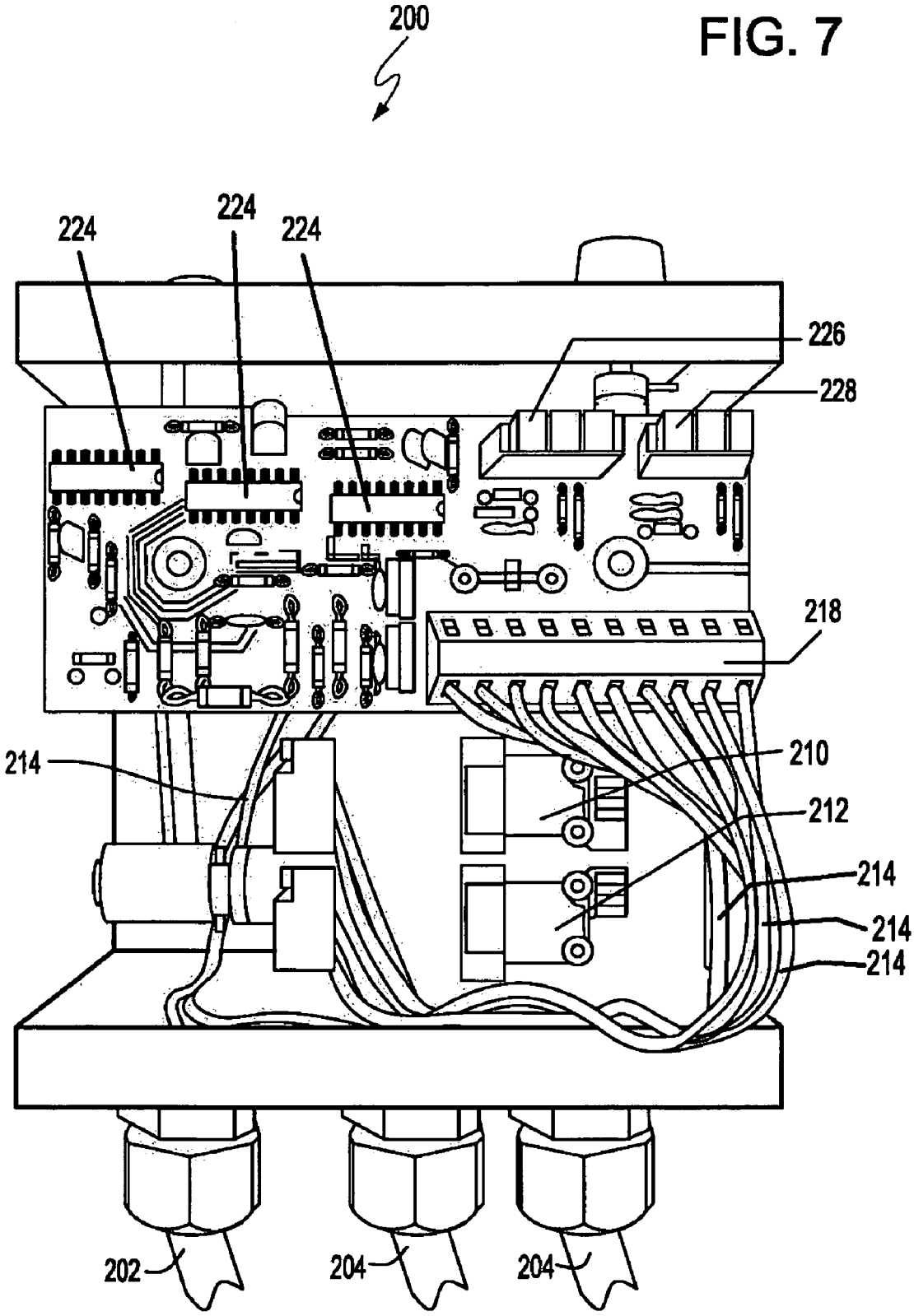
FIG. 7 is a plan view of internal components of a second embodiment of a pneumatic control capable of operating a variable pitch fan.
Figure 8:
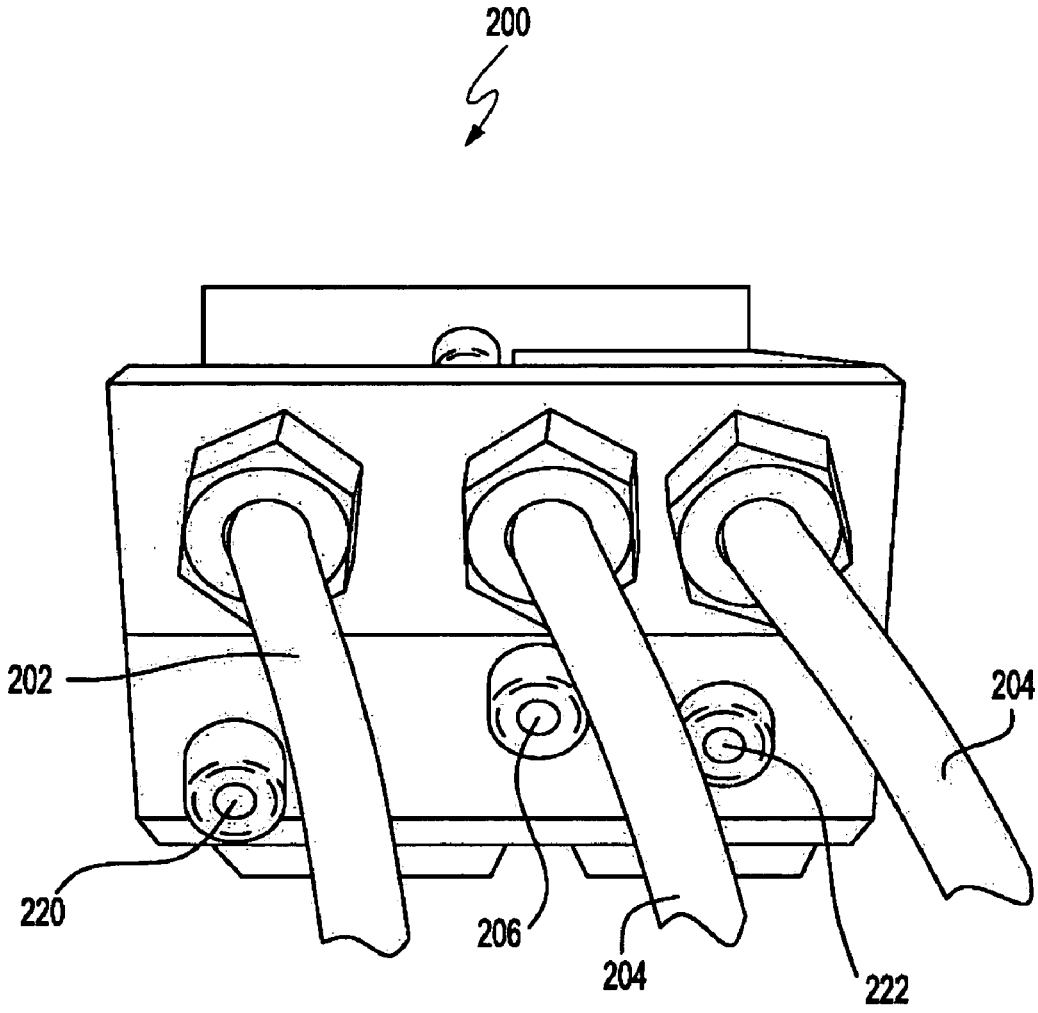
FIG. 8 is a side elevational view of the control of FIG. 7.

Referring now to FIGS. 7 and 8, another embodiment of a control that is incorporated as a pneumatic control for a variable pitch blade fan is generally designated as 200 and illustrated. The control 200 includes a power supply lead 202 for providing power to the control, and a pair of inputs 204 that control air flow direction through a valve assembly similar to the valve assembly of the first embodiment of the control 10. An advantage of the present embodiment control 200 is that the relays and solenoid valves are combined into a pair of units, which results in less components in the control 200 and reduced manufacturing costs.

As best seen in FIGS. 7 and 8, a port 206 of the pneumatic control 200 is configured to receive a pressurized air supply.

After the pressurized air supply is provided to the control 200 the air supply is redirected by a pressure regulator 208, a high pressure solenoid valve 210, and a low pressure solenoid valve 212, similar to the control 10 described herein. The valves 210 and 212 are connected to one another by wire leads 214 that are connected to a logic circuit 216, such as at a wire terminal block 218. In this manner, the pressurized air supply can be directed to either a port 220 that supplies air to the fan and directs fan rotation, or an exhaust port 222 that exhausts the air to the ambient and provides pressure relief to the control 200. While the logic circuit 216 is illustrated as a large scale integrated circuit board, it is contemplated that the logic circuit encompasses known types of integrated circuits as well as known conventional electronic circuit substitutes, as is known to those skilled in the art.

The logic circuit 216 includes timers 224, a purge frequency timing mechanism 226, and a purge length timing mechanism 228 that are preferably pre-programmed to set the frequency and length of time that the variable pitch fan operates in the purge mode of operation. More specifically, the logic circuit 216 is designed to cause changes in the direction of air flow passing through the fan based upon a monitoring signal and/or other external input signals provided to the logic circuit and internal purge signals provided by the timers 224, which causes changes in the pitch direction of the fan blades similar to the first pneumatic control 10.

Figure 9:
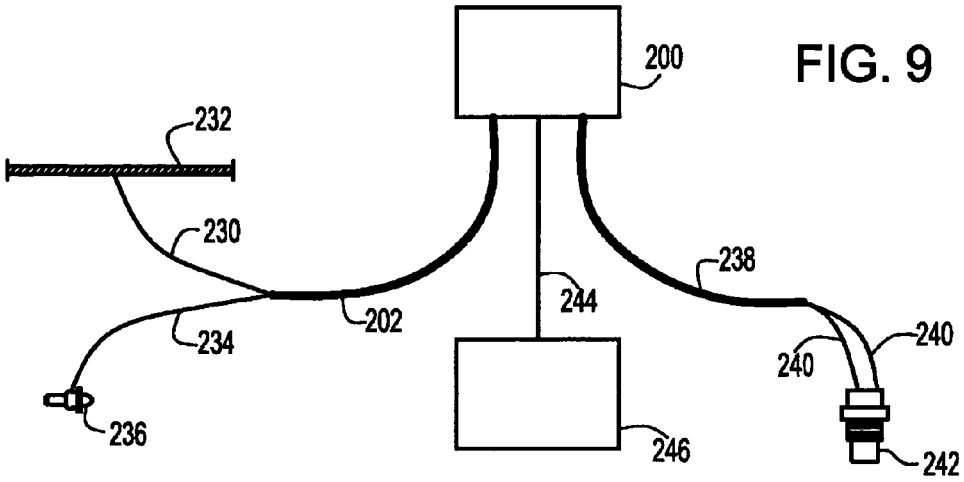
FIG. 9 is a wiring schematic for connecting the second embodiment pneumatic control to vehicular components.

Referring now to FIG. 9, a wiring schematic of the control 200 connected to a power source of a vehicle, such as the vehicle 11, to operate a variable pitch fan is shown. An advantage of the present second embodiment control 200 is that it combines a relay with each of the solenoid valves 210, 212 to change the direction of pressurized air flow though the fan, and hence the rotation of the fan blades so that the fan can operate in the various operating modes. The purge mode is implemented by the logic circuit 216 transmitting a purge signal generated by at least one of the timers 224, which are regulated by the timing mechanisms 226 and 228. In the present embodiment, these timers 224 are configured for generating the purge signal.

The control 200 receives power via the power supply line 202, which has a high voltage lead 230 electrically connected to a vehicle chassis key high voltage line 232, and a low voltage lead 234 electrically connected to a common vehicle chassis ground 236. As an exemplary engine monitoring parameter, a temperature line 238 includes a pair of leads 240 that are electrically connected to a temperature sensor 242. The polarity of the temperature sensor 242 is such that the leads 240 may be interchanged without effecting monitoring information provided to the control 200 via the temperature line 238. The temperature sensor 242 is preferably configured to indicate that a certain threshold, such as an engine temperature of at least 100° F. has occurred. The control 200 is also electrically connected to an A/C line 244 and a relay assembly 246. The relay assembly 246 is connected to the logic circuit 216 and is configured for receiving the fan control signal and the purge signal to operate a fan in a plurality of operating modes.

As used herein, the relay assembly 246 can include one or more relays that are connected by relay terminals and enable actuation of solenoids between a closed or conducting position and an open or non-conducting position. In particular, it is envisioned that the present relay assembly 246 is configured for having terminals to a first internal relay to actuate a first solenoid during fan cooling. Moreover, it is contemplated that as is known to those skilled in the art, the direction of air flow to cause cooling or purging will vary depending on, for example, the pitch of the fan blades.

Figure 10:
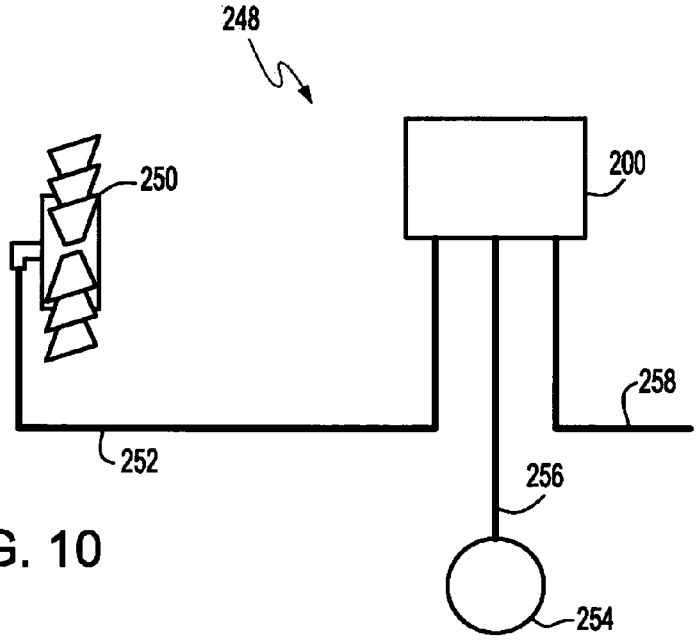
FIG. 10 is a fluid schematic of the pressurized air flow through the control of FIG. 7.

FIG. 10 illustrates a fluid schematic of the air flow to the control 200 when operating a variable pitch fan system, generally designated as 248, of a vehicle or the like having a cooling core. The fan system 248 includes a variable pitch fan 250 that connects to the control 200 via an air supply line 252 that provides compressed air from the port 220 (FIG. 8) of the control 200 to the fan. The compressed air is generated by an air compressor 254, which feeds the air via a line 256 to the port 206 of the control 200. An exhaust line 258 connects to the exhaust port 222 of the control 200 and exhausts the air from the fan system 248.

Figure 11:
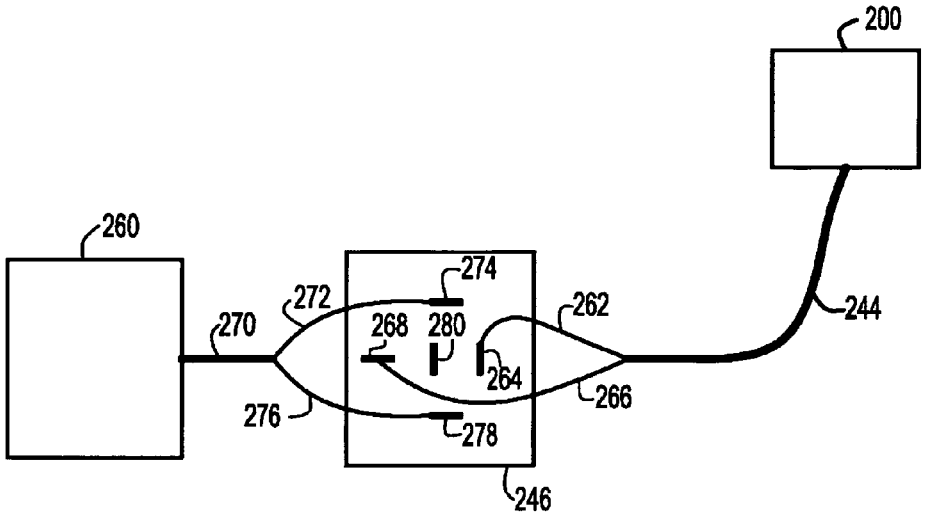
FIG. 11 is a wiring schematic for connecting the second embodiment pneumatic control to a relay and ECM.

FIG. 11 illustrates a wiring schematic for connecting the control 200, the A/C line 244, and the relay assembly 246 to an ECM 260. The ECM 260 is configured to transmit one or more monitoring signals that direct the fan 250 to operate in the cooling mode, unless the fan is overridden by the logic circuit 216 transmitting a signal to the fan to operate in the purge mode. More specifically, the logic circuit 216 receives the monitoring signal of the ECM 260 via the relay assembly 246 and generates a fan control signal based on the monitoring signal, which instructs the fan to operate in the cooling mode or the neutral mode of operation. In one embodiment, the present relay assembly 246 and control 200 are contemplated for use in place of a clutch system (not shown) that is controlled by a solenoid switch to turn the fan 250 on and provide cooling. In the present embodiment, it is envisioned that the monitoring signal or signals are high voltage signals when received at the logic circuit 216 to instruct to the fan 250 to turn off in the neutral mode of operation, and are zero voltage signals when received at the logic circuit to instruct the fan to turn on in the cooling mode of operation. However, it is contemplated that one skilled in the art could reverse polarity of the monitoring signals transmitted to the logic circuit 216 to operate the fan 250 in the cooling and neutral modes of operation.

The A/C line 244 has a high voltage lead 262 that connects to a terminal 264 of the relay assembly 246, and a low voltage lead 266 that connects to a terminal 268 of the relay. The ECM 260 connects to the relay assembly 246 via a line 270 that has a high voltage lead 272 that connects to a terminal 274 of the relay and a low voltage lead 276 that connects to a terminal 278 of the relay. If there is no low voltage signal transmitted by the ECM 260 requiring the fan 250 to turn on and begin cooling, the line 270 does not provide any signal to the relay assembly 246, which is configured as a normally closed relay. Consequentially, the normally closed relay assembly 246 does not transmit a signal to the control 200 (i.e., until the relay assembly opens), which results in the logic circuit 216 of the control 200 instructing the fan 250 to operate in the neutral mode, unless the fan is overridden by the logic circuit transmitting a signal via the timers 224 to the fan to operate in the purge mode.

When the ECM 260 transmits a signal to the relay assembly 246 to begin cooling, the normally closed relay switches from a closed position to an open position. The open relay assembly 246 then transmits a low voltage monitoring signal to the logic circuit 216 requesting the fan 250 to operate in the cooling mode, i.e., to turn on and begin cooling, unless the fan is overridden by the logic circuit. That is, the logic circuit 216 continues to operate the fan 250 in either the neutral or cooling modes based on a signal from the ECM 260, unless overridden by the logic circuit instructing the fan to operate in the purge mode. As previously discussed, the purge mode is usually preset to occur periodically and for a set time period using the timers 224 and the timer mechanisms 226 and 228.

To install the control 200 in the vehicle 11 or other equipment having a cooling core, the leads 272 and 276 from the ECM 260 are first disconnected. The normally closed relay assembly 246 is then mounted on the vehicle/equipment to facilitate electrical connection of the relay to the ECM 260. The high voltage lead 262 is next connected to the terminal 264, and the low voltage lead 266 is connected to the terminal 268. The leads 272 and 276 are then reconnected to the relay assembly 246.

Figure 12:
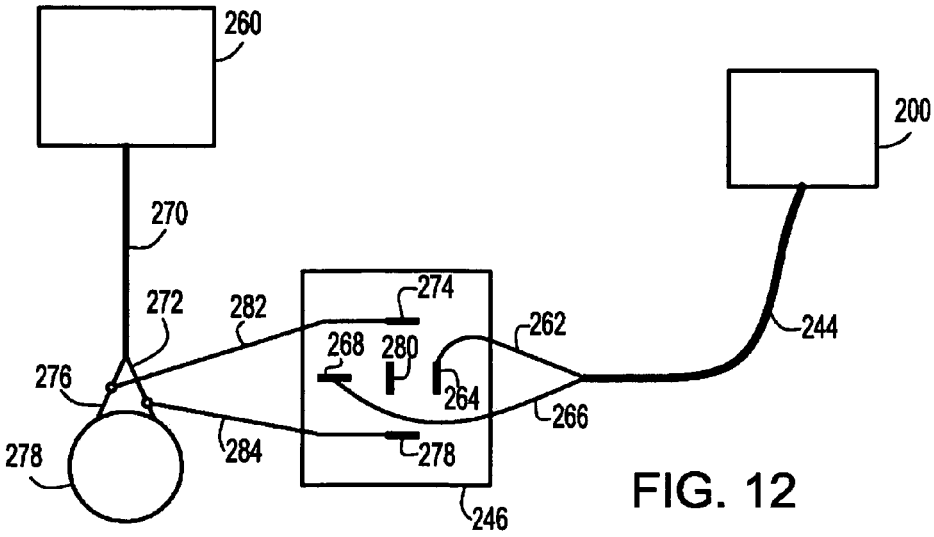
FIG. 12 is a wiring schematic for connecting the second embodiment pneumatic control via a relay to an A/C clutch and ECM.

Turning now to FIG. 12, a wiring schematic for connecting the control 200 via the relay assembly 246 to an A/C clutch 278 of a vehicle and the ECM 260 is shown. The relay assembly 246 is identical to the relay of FIG. 11. The relay assembly 246 includes a terminal 280 that receives the lead 262 of the A/C line 244 instead of the terminal 264. The lead 266 of the A/C line 244 remains connected to the terminal 268 of the relay assembly 246. The leads 272 and 276 of the line 270 are electrically connected to the A/C clutch 278. A line 282 connects relay terminal 274 to the lead line 276, and a line 284 connects relay terminal 278 to the lead line 272.

To install the control 200 in the vehicle having the A/C clutch 278, the leads 282 and 284 are connected to the A/C clutch. The normally closed relay assembly 246 is next preferably conveniently mounted on the vehicle/equipment to allow electrical connection to the ECM 260 and the A/C clutch 278. The high voltage lead 262 is then connected to the terminal 274, and the low voltage lead 266 is connected to the terminal 268. The leads 282 and 284 and then reconnected to the relay assembly 246.

Figure 13:
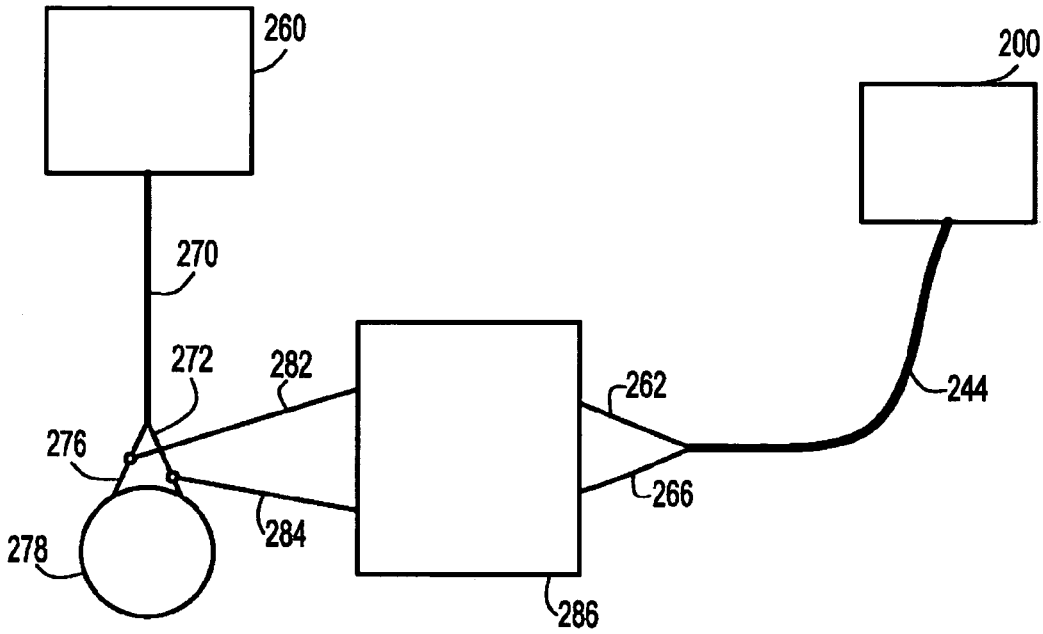
FIG. 13 is a wiring schematic for connecting the pneumatic control via a transmitter to an A/C clutch and ECM.

FIG. 13 illustrates a wiring schematic for connecting the control 200 to the A/C clutch 278 and the ECM 260 of a vehicle with the relay being replaced by a transmitter 286. The transmitter 286 may include a logic element or board such as a diode circuit, transistor circuit, or other logic circuit capable of providing a signal (or no signal) to the control 200 to operate the fan 250 in the cooling mode or the neutral mode. Moreover, it is contemplated that the transmitter 286 can be formed as an integrated circuit on the logic circuit 216 of the control 200 to further reduce components and/or cost for operating the fan 250 in the neutral, cooling, and purge modes as is known to the skilled in the art.

Figure 14:
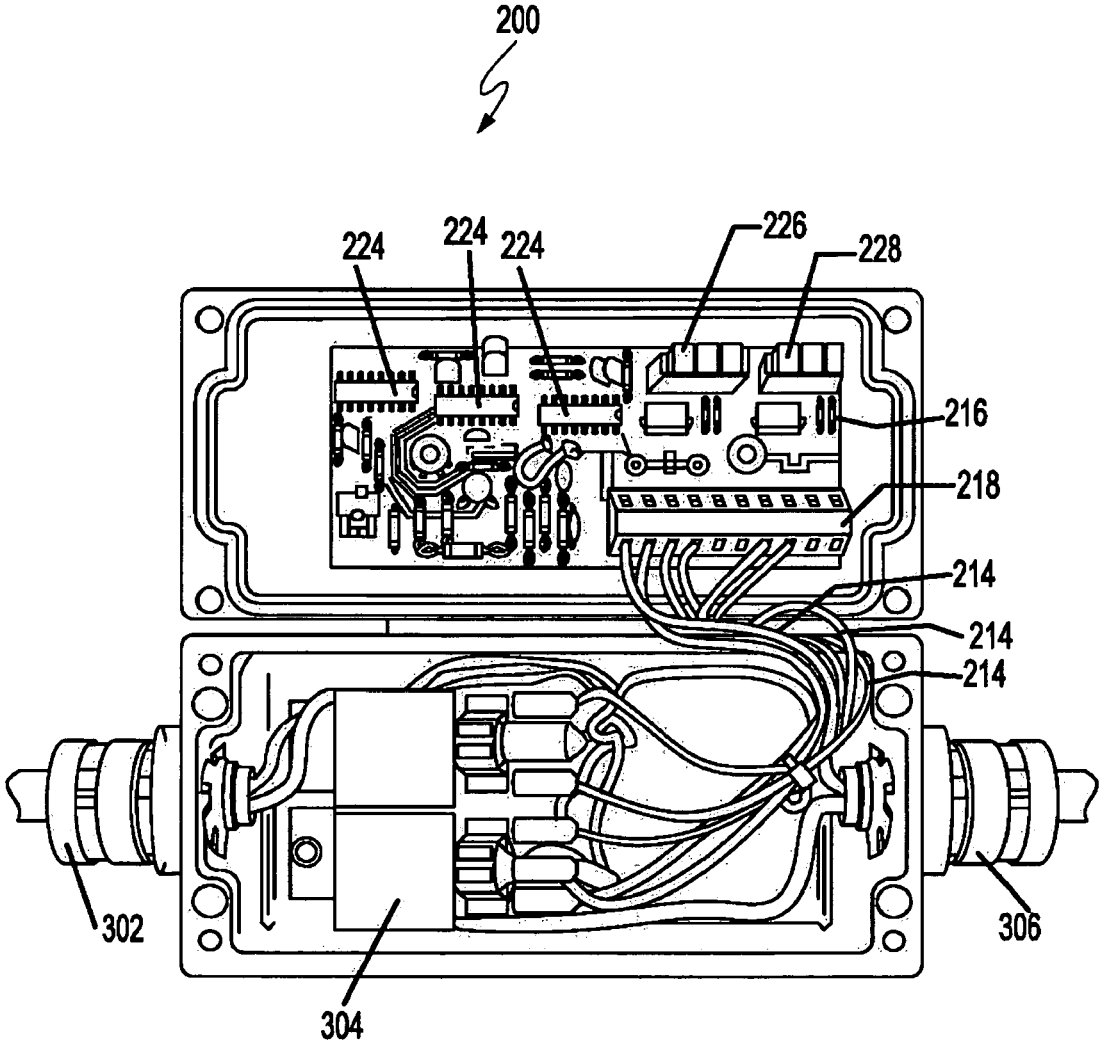
FIG. 14 is a plan view of internal components of an electric control capable of operating a non-variable pitch fan.
Figure 15A:
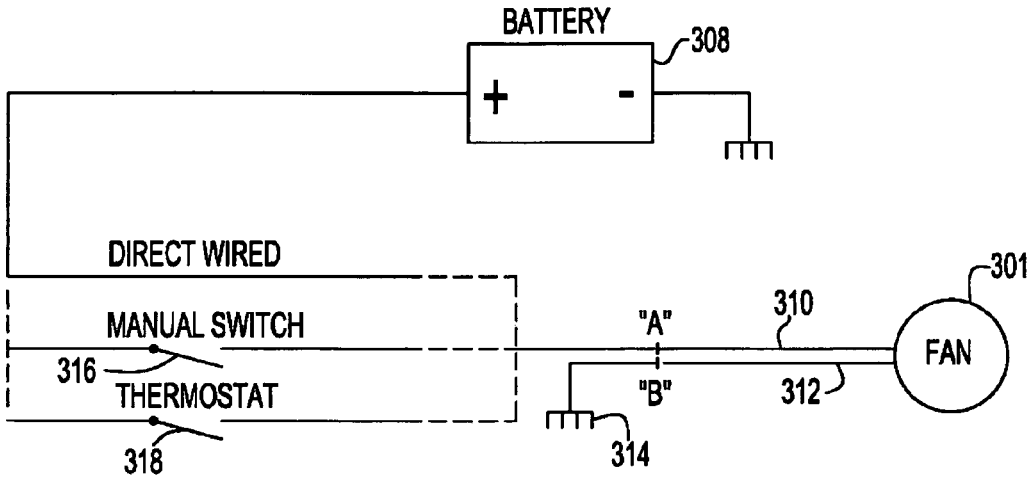
FIG. 15A illustrates an exemplary wiring connection of a power source to a non-variable pitch fan of a vehicle.
Figure 15B:
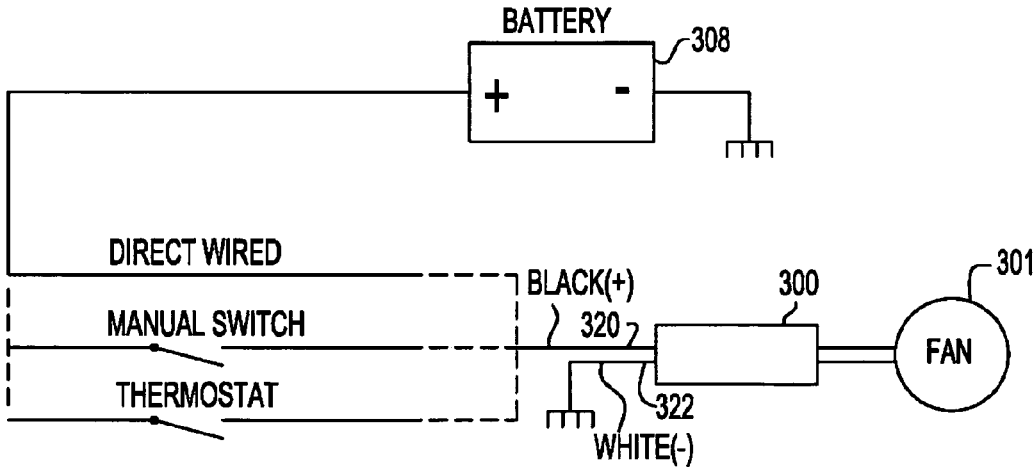
FIG. 15B illustrates the exemplary wiring connection of FIG. 15A with an electric control controlling the fan.

Referring now to FIG. 14, another embodiment of a control, generally designated as 300, which is incorporated as an electric control, is shown for use with a non-variable pitch type fan 301 (FIGS. 15A and 15B). The control 300 has like components of the control 200 identified with identical reference numerals. Similar to the control 200, the control 300 is capable of changing a direction of air flow through the cooling core. More specifically, a feature of the present control 300 is that the control can change a rotational direction of the fan 301 electronically using relays to effect a change in air flow direction through the fan and a cooling core by changing the direction of rotation of the fan between a clockwise and a counterclockwise direction. However, unlike the relay group 246 of the control 200, the present relays are configured to direct electric current flow through a DC motor of a non-variable pitch fan 301 and have a reversed polarity for operating the fan 301 in the cooling and neutral modes of operation in comparison to the relay assembly 246 of the control 200.

The control 300 has an input line 302 that feeds power and other external data to the control. More specifically, power and monitoring data from an ECM or other monitoring switch are inputted via the line 302 to a relay assembly formed by a pair of relays, generally designated as 304. The relays 304 are configured to provide electric current to the fan 301 to cause rotation of the fan in a first direction (e.g., clockwise direction) and also in a reversed polarity second direction (e.g., a counterclockwise direction). The monitoring inputs provide information, such as whether a threshold engine temperature has occurred, which enables the control 300 to transmit a signal to the non-variable pitch fan 301 and cause the fan to operate in one of the neutral or cooling modes of operation. Similar to the control 200, the control 300 also includes a logic circuit 216 for selecting when the fan 301 operates in a purge mode. However, unlike the logic circuit 216 of the control 200, the present logic circuit is configured to cause a rest delay prior to changing the fan 301 from the cooling mode to the purge mode and vice-versa.

The logic circuit 216 of the control 300 includes a plurality of timers 224, a timer assembly 226 for selecting a frequency at which the fan 301 operates in the purge mode, and a timer assembly 228 for selecting a length of time that the fan operates in the purge mode. The timer assembly 226 in conjunction with the timers 224 can be set for a specific time period, such as every 10 minutes, that a purge mode occurs. The timer assembly 228 in conjunction with the timers 224 determines for how long the fan 301 operates in the purge mode, e.g., 3 minutes.

In the purge mode, the monitoring signal received by the control 300 at the input 302 is overridden. That is, a fan control signal instructing the fan 301 to operate in a cooling mode of operation or in the neutral mode is ignored, and the purge mode occurs upon completion of the rest delay time period.

It is contemplated that the logic circuit 216 of the control 300 is configured to operate similar to the logic circuit of the control 200 except that no signal is transmitted to the relays 304 for a set time period once a change of rotational direction of the blades of the fan 301 occurs, and polarity is reversed for generating the fan control signal. That is, if a high voltage signal is received by the logic circuit 216, a fan turn on signal is generated. A low voltage signal to the logic circuit 216 results in a fan turn off signal being generated, which causes the fan 301 to operate in the neutral mode. In particular, the logic circuit 216 is preferably equipped with internal circuitry to monitor signals indicative of a plurality of cooling core and/or fan parameters provided by an ECM, pressure switch, a/c switch, or any other components transmitting monitoring signals to the logic circuit which would indicate that a fan 301 should be turned on or off to cool or cease cooling a cooling core. In particular, engine monitoring signals (or a lack thereof) provided by an ECM or other component are contemplated as being capable of being processed by the logic circuit 216 of the present invention to cause the fan 301 to operate in the neutral and cooling modes unless overridden by a purge signal. Preferably, the logic circuit 216 of the control 300 is also configured to operate the fan 301 in the neutral mode when a low voltage monitoring signal is provided to the input 302 and a cooling mode when a high voltage monitoring signal is provided to the input, unless the fan 301 is overridden by a purge signal from the logic circuit causing the fan to operate in the purge mode upon completion of the rest delay time period. However, it is contemplated that one skilled in the art could alter the polarity by adding inverters or other logic components to the control 300.

As previously indicated, it is further contemplated that the cooling mode can be defined by rotation of the non-variable pitch fan 301 in a first direction (e.g., a clockwise direction) and the purge mode in a second direction opposite to the first direction (e.g., a counter-clockwise direction). The neutral mode can include no rotation or a reduced rotation of the fan 301 (i.e., a no air flow condition or a reduced air flow condition), and can occur by power being reduced or not supplied to a DC motor (not shown) of the fan via the output 306.

The control 300 preferably includes a pair of relays 304 as discussed above which control electric current flow to a DC motor and the direction of fan blade rotation. More specifically, the present embodiment includes a pair of relays 304 that transmit a fan forward clockwise rotation control signal by providing electric current to the DC motor of the fan 301, or a fan reverse counterclockwise control signal by changing the polarity of the electric current received by the fan.

FIG. 15A illustrates a partial exemplary wiring schematic of the non-variable pitch fan 301 connected to a power source, such as a battery 308, without the control 300. A positive lead line 310 connects the fan 301 to the battery 308 and a negative lead line 312 connects the fan 301 to a ground 314. The positive lead line 310 can be directly connected to the fan 301, or alternatively connected via a manual switch 316 or a thermostat 318 as shown in dashed lines.

FIG. 15B illustrates the control 300 connected to the battery 308 and the fan 301 shown in FIG. 15A. Upon installation of the control 300, the positive battery lead 310 is first fed into a positive terminal 320 of the control and then to the fan 301. The ground 314 of the negative lead line 312 feeds into a negative terminal 322 of the control 300 and is then fed from the control to the fan 301.

Figure 16A:
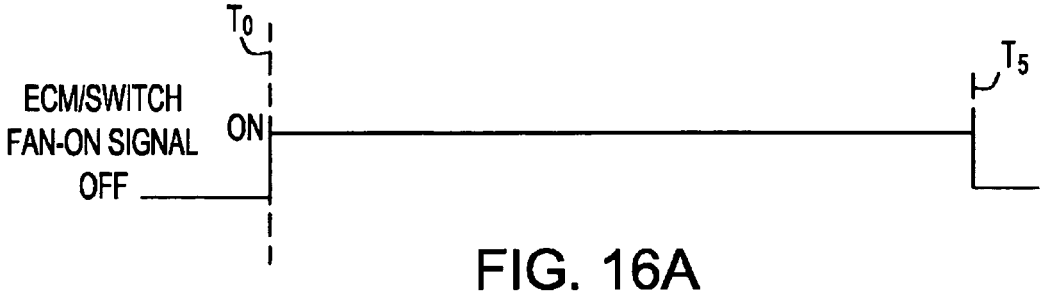
FIG. 16A schematically illustrates an external fan on/off signal transmitted by an ECM or monitoring switch.
Figure 16B:
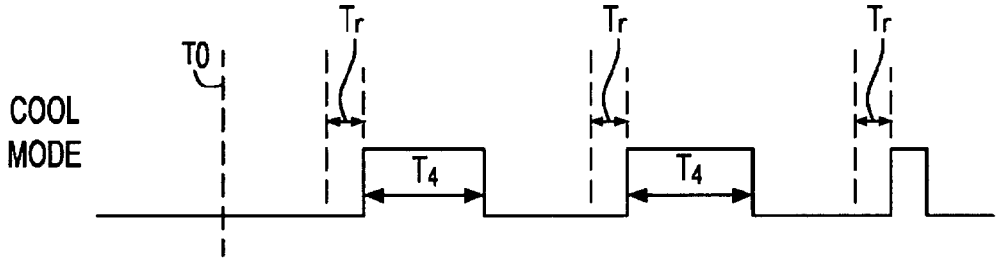
FIG. 16B is a timing schematic of the operation of the fan operating in the cooling mode for the electric control of FIG. 15B.
Figure 16C:
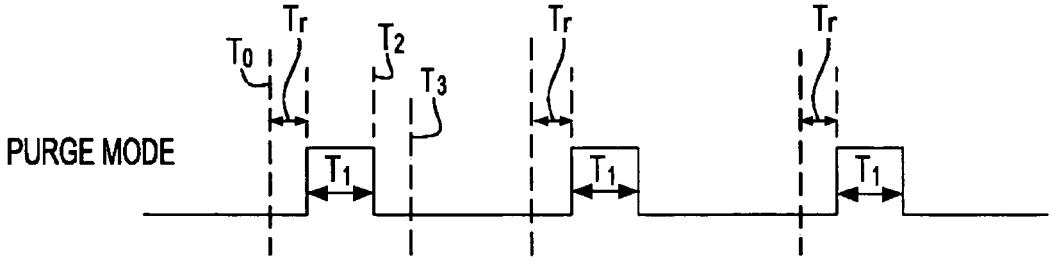
FIG. 16C is a timing schematic of the operation of the fan operating in the purge mode for the electric control of FIG. 15B.

Turning now to FIGS. 16A–C, timing schematics showing the operation of the non-variable pitch fan 301 while being controlled by the control 300 are illustrated and show the fan operating in the neutral, purge, and cooling modes. Initially, prior to a time $T_0$ an ECM, such as the ECM 260 (FIG. 11), provides no signal (e.g., a fan off signal) to the logic circuit 216, which causes the fan 301 to operate in the neutral mode. After the time $T_0$, the ECM 260 provides a monitoring signal to the logic circuit 216 which instructs the fan 301 to turn on (e.g., rotate clockwise) by having one of the relays 304 pass electric current to the DC motor, which cools the cooling core and other components of the cooling system.

As used herein, a high voltage signal is preferably a signal that has a voltage greater than a low voltage signal. By way of example only, the high voltage signal may be a 5V signal and the low voltage signal (or no signal) may be a 0V signal inputted to the logic circuit 216 of the control 300. The ECM 260 continues to provide the monitoring signal to the logic circuit 216 until the ECM determines that no further cooling is necessary at a time $T_5$. At the time $T_5$ no signal is provided to the logic circuit 216, electric current flow to the DC motor of the fan 301 is discontinued, and the fan operates in the neutral mode.

FIG. 16B shows the timing schematic during the cooling mode of the non-variable pitch fan 301, and FIG. 16C illustrates the timing schematic during the operation of the non-variable pitch fan in the purge mode. By way of example, the cooling mode can be considered as a full speed fan forward clockwise rotation, and the purge mode as a full speed fan 301 reverse counterclockwise rotation. Initially, prior to the time $T_0$, the fan 301 is operating in a neutral mode, for example a no fan blade rotation mode, and has no electric current supplied to the DC motor by the relays 304. After the time $T_0$, one cycle C of purge and cooling of the fan 301 is initiated by the fan receiving no electric current and continuing to operate in the neutral mode for a rest delay time period $T_r$. The rest delay time period $T_r$ is provided to protect the fan 301 during a change of fan blade direction of rotation, and allows for a reduction in the rotational speed of the fan before further changing the direction of fan rotation. That is, the rest delay time period reduces the rotation rate of the fan blades prior to the fan 301 switching between the cooling mode (e.g., clockwise rotation) and the purge mode (e.g., counterclockwise rotation), or vice-versa. While the present example of a neutral mode contemplates no electric current being supplied to the DC motor of the fan 301 similar to the rest delay time period, it is contemplated that in the neutral mode a reduced minimal electric current could be provided to the DC motor without being outside the scope of the present invention.

After the rest delay time period $T_r$, a high voltage signal provided to the fan 301 causes the other relay 304 to not activate during the cooling mode to cause electric current to flow to the DC motor of the fan in a reverse polarity as compared to the cooling mode, which causes the fan to operate in the purge mode for the $T_1$ time period. At a time $T_2$, a rest delay time period $T_r$ again occurs prior to the fan 301 receiving a high voltage or cooling mode signal at a time $T_3$, which again reverses the polarity of the electric current flow to the DC motor of the fan. Next, the fan 301 operates in the cooling mode for a time period $T_4$ and completes one cycle. The fan 301 may continue to complete additional cycles until the ECM 260 provides no signal, which results in the logic circuit 216 instructing the fan to operate in the neutral mode. While the purge mode is illustrated in the present embodiment as operating when the ECM 260 provides a fan 301 turn on or other monitoring signal, the present control 300 causes a change in the direction of air flow through a cooling core based on the timers 224 even if the ECM 260 instructs the logic circuit 216 to provide a fan turn on control signal or a fan turn off control signal to the DC motor of the fan.

While particular embodiments of the control have been shown and described, it will be appreciated by those skilled in the art that changes and modifications may be made thereto without departing from the invention in its broader aspects and as set forth in the following claims.

What is claimed is:

1. A control configured for changing a direction of air flow generated by a fan through a cooling core comprising:

a logic circuit configured for receiving a monitoring signal and generating a fan control signal based on said monitoring signal;

at least one timer connected to said logic circuit and configured for generating a purge signal; and a relay assembly connected to said logic circuit and configured for receiving said fan control signal and said purge signal to operate the fan in a plurality of operating modes, wherein said logic circuit includes a plurality of timers configured to generate said purge signal.

2. The control of claim 1, further comprising a timing mechanism configured for controlling a period of said purge signal.

3. The control of claim 2, wherein said logic circuit further includes a second timing mechanism configured for controlling a frequency at which said timers generate said purge signal.

4. The control of claim 1, wherein the fan is a variable pitch fan having fan blades and said relay assembly alters a pitch of the fan blades of the fan.

5. The control of claim 1, wherein said fan is a non-variable pitch fan having fan blades and the relay assembly causes a change in a direction of rotation of the fan blades.

6. The control of claim 1, wherein said control is an electric control.

7. A control configured for changing a direction of air flow generated by a fan through a cooling core comprising:

a logic circuit configured for receiving a monitoring signal and generating a fan control signal based on said monitoring signal;

at least one timer connected to said logic circuit and configured for generating a purge signal; and a relay assembly connected to said logic circuit and configured for receiving said fan control signal and said purge signal to operate the fan in a plurality of operating modes, wherein said relay assembly comprises a pair of relays, and wherein said pair of relays comprise a first relay having a low pressure solenoid and a second relay having a high pressure solenoid.

8. A control configured for changing a direction of air flow generated by a fan through a cooling core comprising:

a logic circuit configured for receiving a monitoring signal and generating a fan control signal based on said monitoring signal;

at least one timer connected to said logic circuit and configured for generating a purge signal; and a relay assembly connected to said logic circuit and configured for receiving said fan control signal and said purge signal to operate the fan in a plurality of operating modes, wherein said control is a pneumatic control.

9. A method of selectively controlling a direction of an air flow to a cooling core, the air flow provided by a fan capable of operating in a neutral mode, a purge mode, and a cooling mode, comprising:

monitoring a predetermined parameter of the cooling core;

determining if said monitored predetermined parameter exceeds a threshold, and if not, operating the fan in the neutral mode, otherwise transmitting a fan on signal to a control to operate the fan in the cooling mode; and periodically transmitting a purge signal to said control to override said transmitted fan on signal and operate the fan in the purge mode.

10. The method of claim 9, further comprising the step of providing a time delay turning said fan off prior to periodically transmitting a purge signal to said control to operate the fan in the purge mode.

11. The method of claim 10, further comprising the step of providing a second time delay turning said fan off upon completion of the purge mode.

12. The method of claim 9, wherein said predetermined parameter is a temperature parameter.

13. The method of claim 12, wherein said threshold is 100°.

14. The method of claim 9, wherein said predetermined parameter is a signal generated by one of an electronic control module and a switch.

15. The method of claim 14, wherein the switch is a pressure switch and said threshold is 40 psi.

16. A control for a fan comprising:

means for receiving a monitoring signal and generating a fan signal based on said monitoring signal;

means for generating a purge signal configured for overriding said fan signal;

means for controlling a direction of rotation of the fan in one of a clockwise direction and a counterclockwise direction based on said purge signal and said monitoring signal, wherein said means for receiving a monitoring signal comprises a logic circuit having an input terminal configured for receiving said monitoring signal, and wherein said means for controlling a direction of rotation of the fan comprises a pair of relays connected to said logic circuit.

* * * * *